US012687360B1

(12) United States Patent
Ervin et al.

(10) Patent No.: US 12,687,360 B1
(45) Date of Patent: Jul. 21, 2026

(54) CHAMBER OBSTRUCTION DEVICE FOR FIREARM

(71) Applicant: Ervin Innovations, LLC, Spokane Valley, WA (US)

(72) Inventors: Dylan Scott Ervin, Spokane Valley, WA (US); Zachary G. Ervin, Spokane Valley, WA (US)

(73) Assignee: Ervin Innovations, LLC, Spokane Valley, WA (US)

( * ) Notice: Subject to any disclaimer, the term of this patent is extended or adjusted under 35 U.S.C. 154(b) by 63 days.

(21) Appl. No.: 18/891,989

(22) Filed: Sep. 20, 2024

(51) Int. Cl.
*F41A 17/44* (2006.01)

(52) U.S. Cl.
CPC ..... *F41A 17/44* (2013.01)

(58) Field of Classification Search
CPC ..... F41A 17/44
See application file for complete search history.

(56) References Cited

U.S. PATENT DOCUMENTS 11,435,154 B2 * 9/2022 Ervin ..... F41A 17/44

* cited by examiner

*Primary Examiner* — Reginald S Tillman, Jr.
(74) *Attorney, Agent, or Firm* — Lee & Hayes, P.C.

(57) ABSTRACT

A device includes a locking mechanism that transitions between a locked state and an unlocked state. The locking mechanism has a first depressible member that actuates in a first direction and second depressible members that actuate in a second direction different than the first direction. Fastening mechanisms that secure the second depressible members to the device. A cover transitions between a first position in which the fastening mechanisms are obstructed and a second position in which the fastening mechanisms are unobstructed. The cover transitions from the first position to the second position in the unlocked state of the locking mechanism. A slide engages with the cover and permits transitioning of the cover from the first position to the second position.

14 Claims, 26 Drawing Sheets

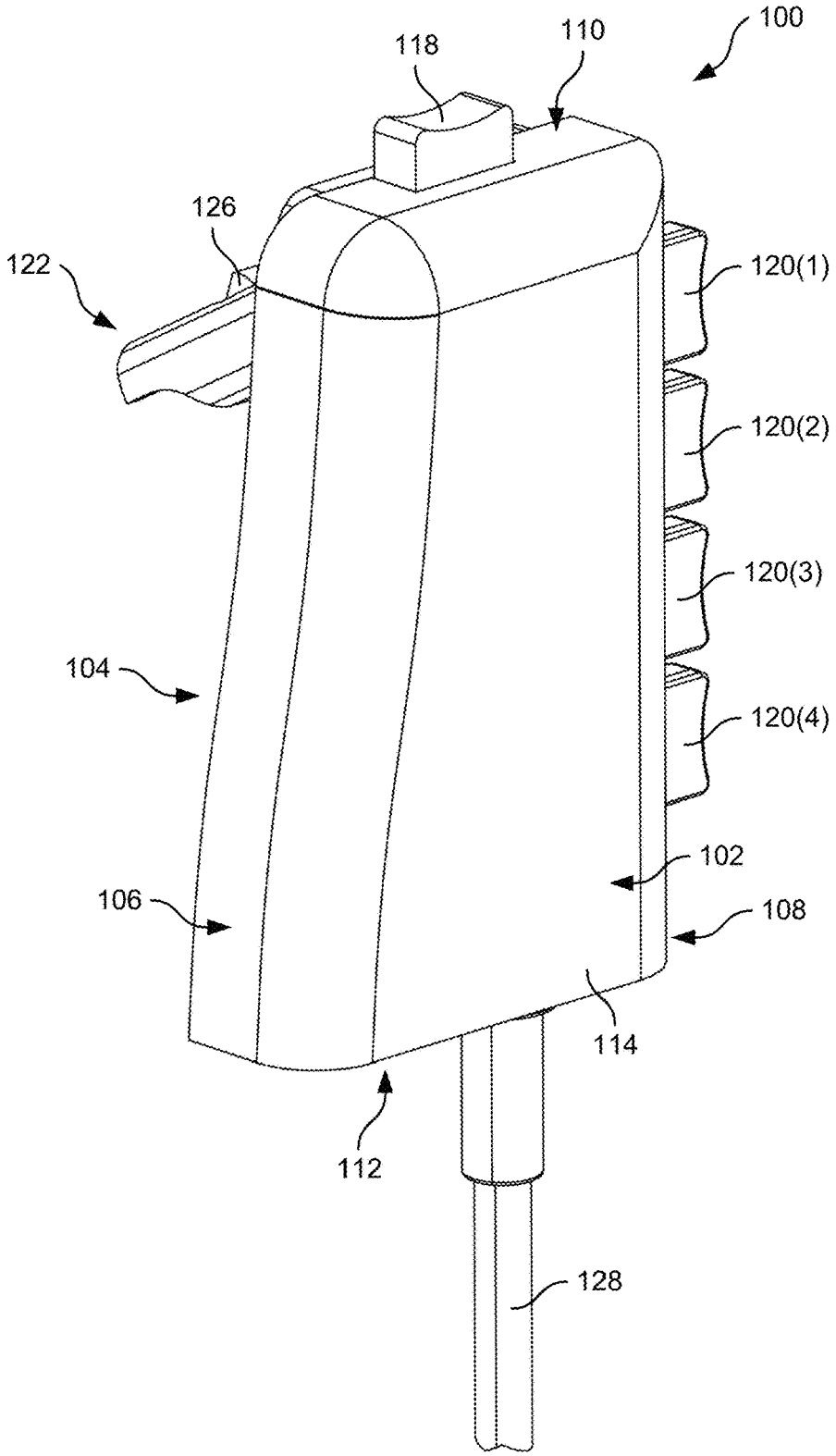
FIG. 1A
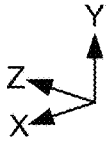

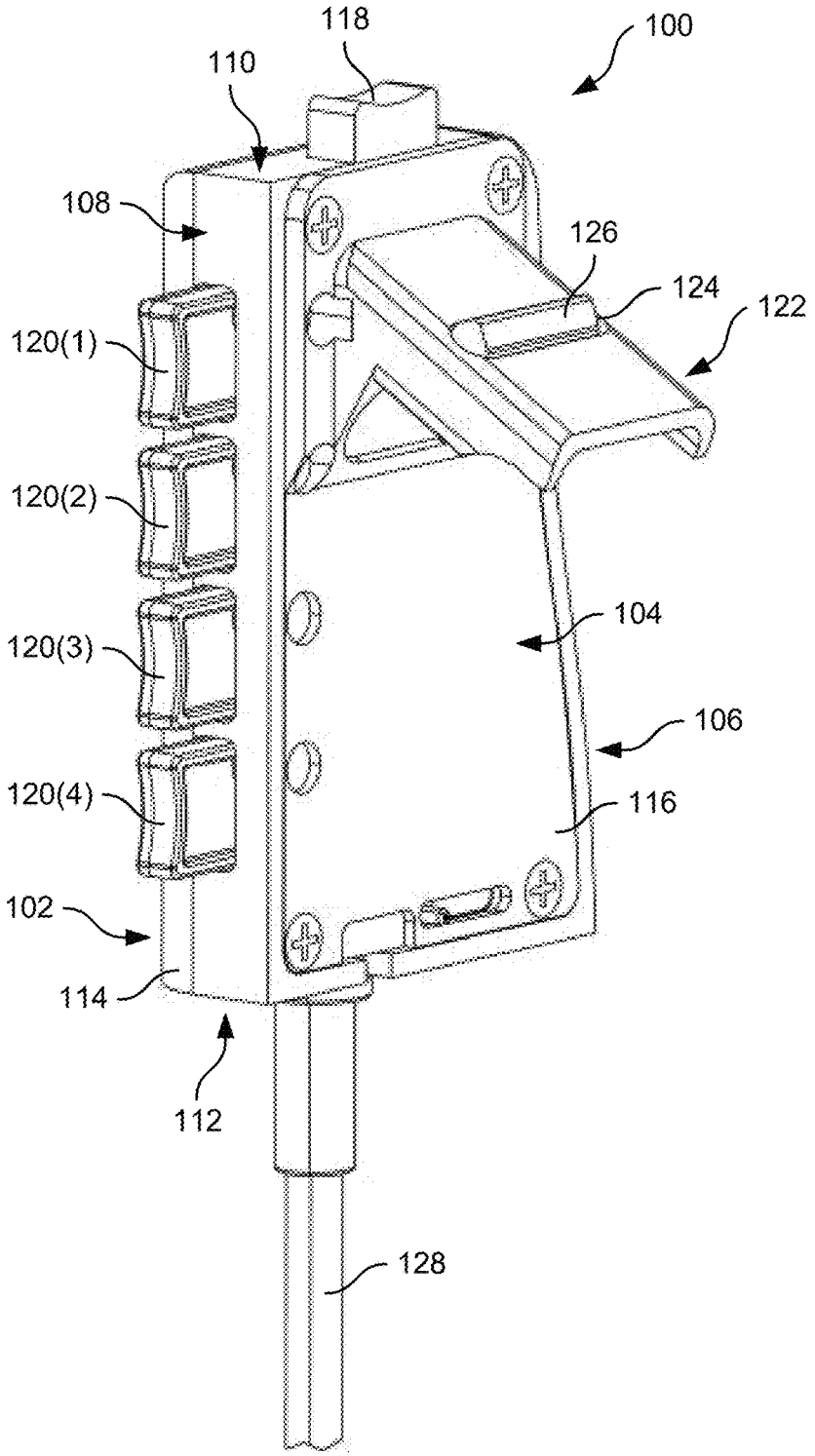
FIG. 1B
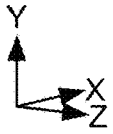

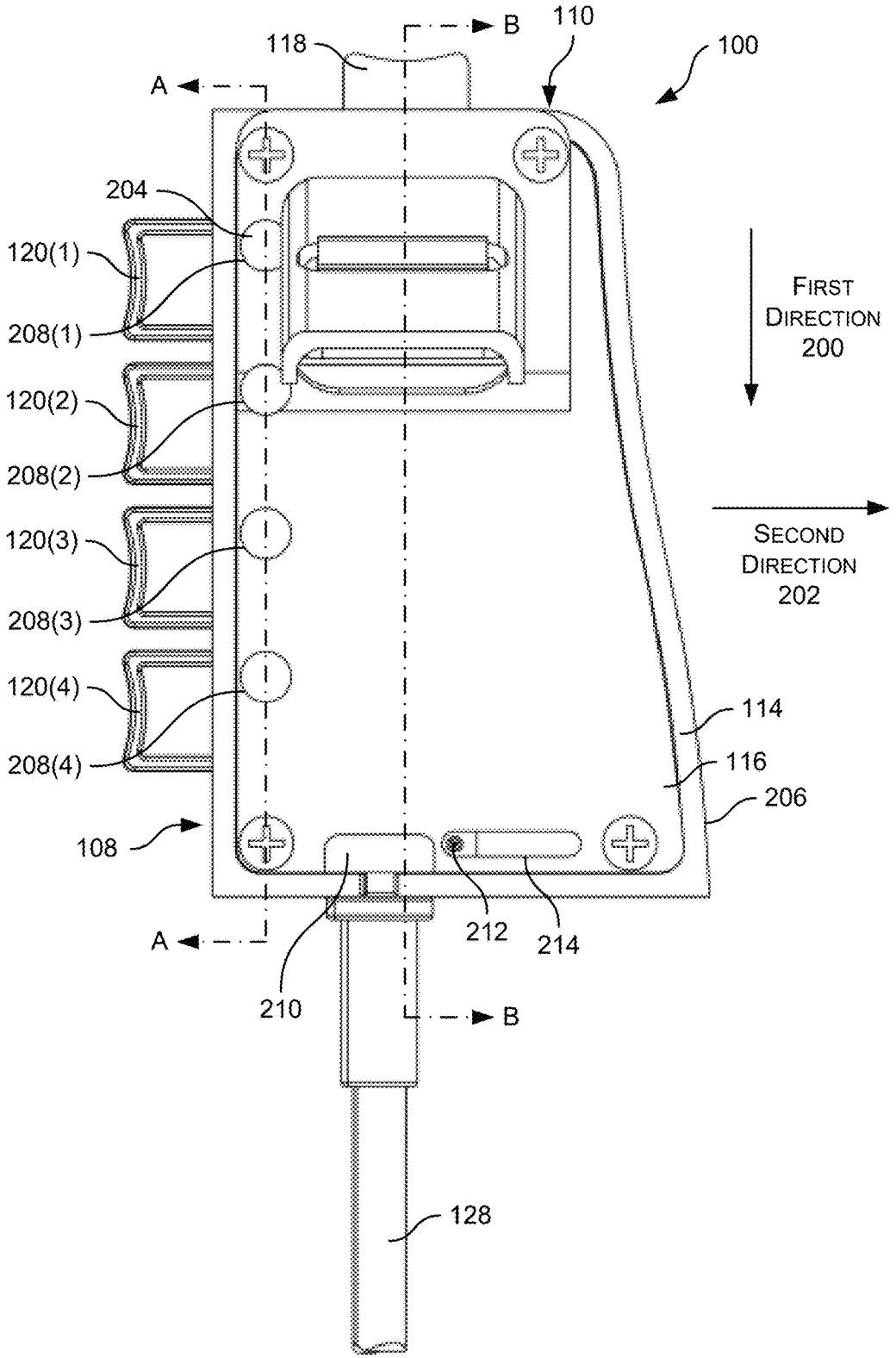
FIG. 2
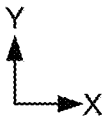

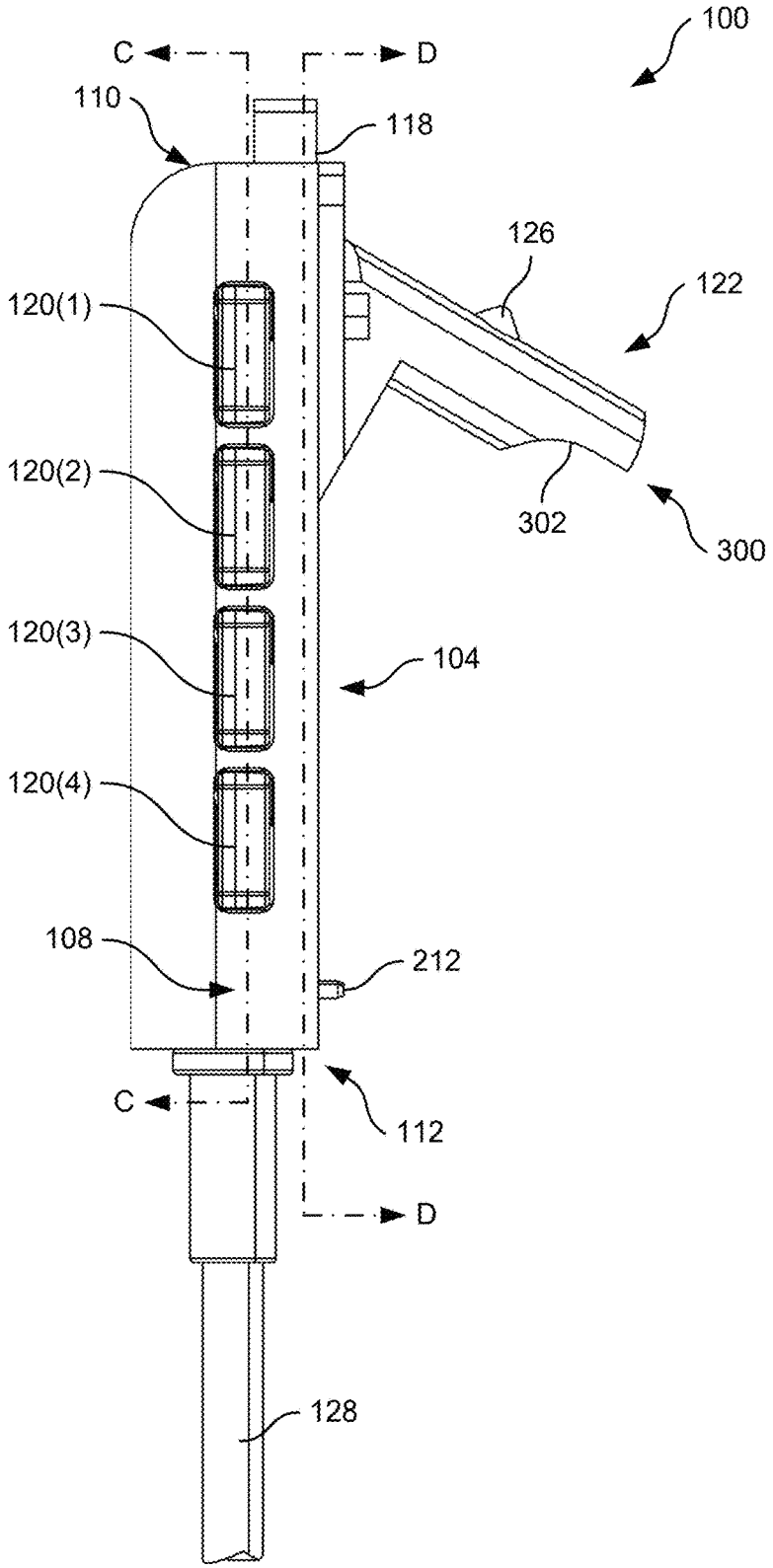
FIG. 3
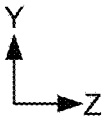

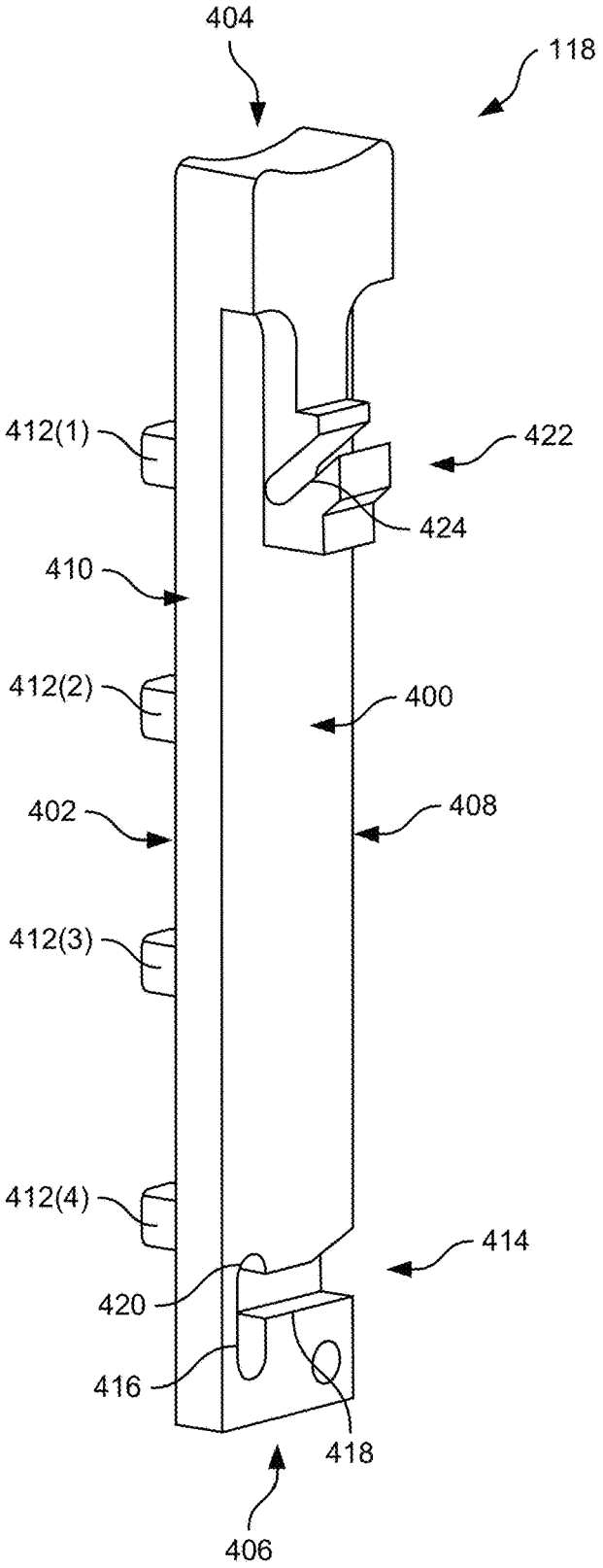
FIG. 4A
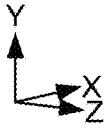

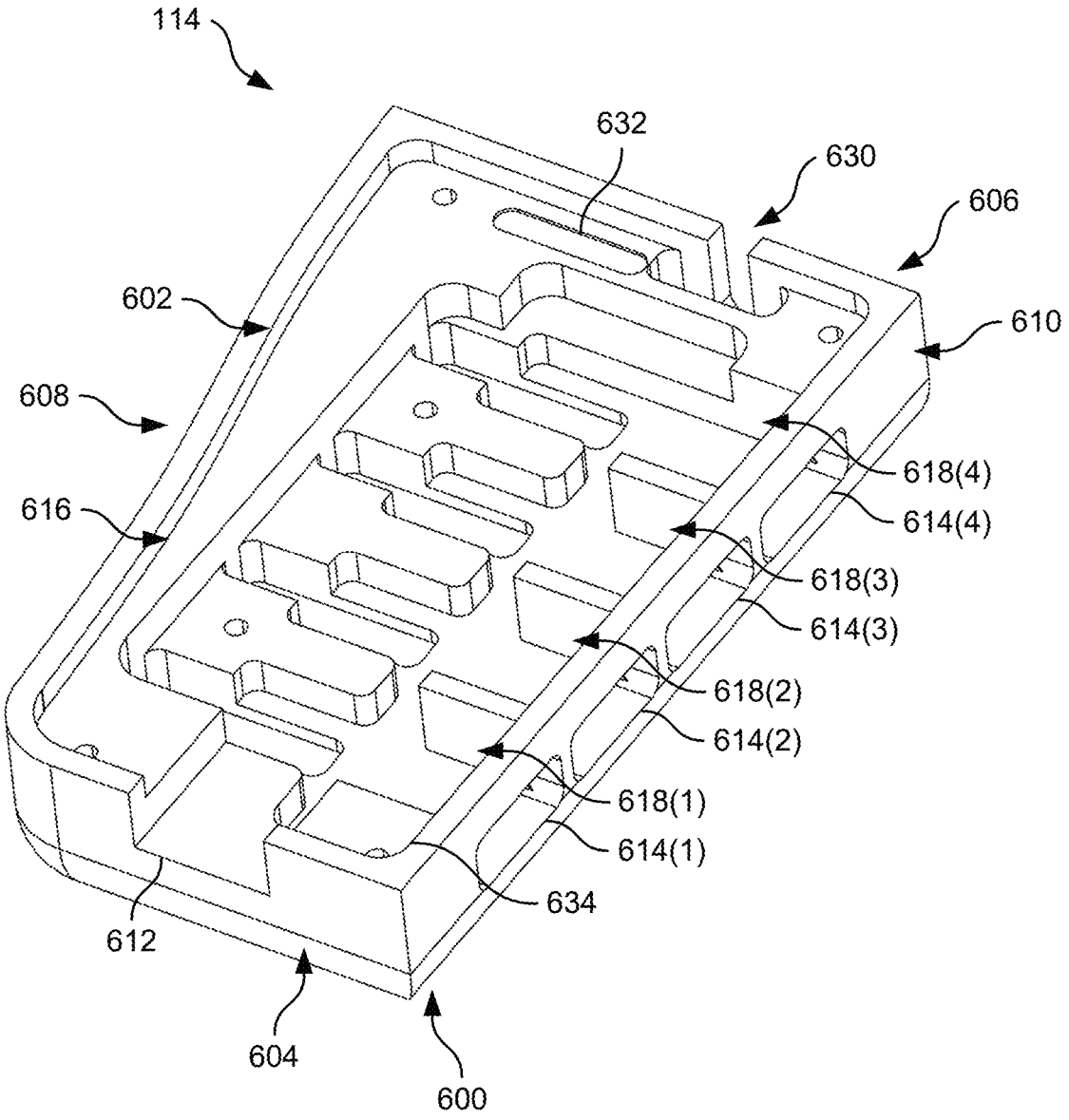
FIG. 6A
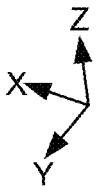

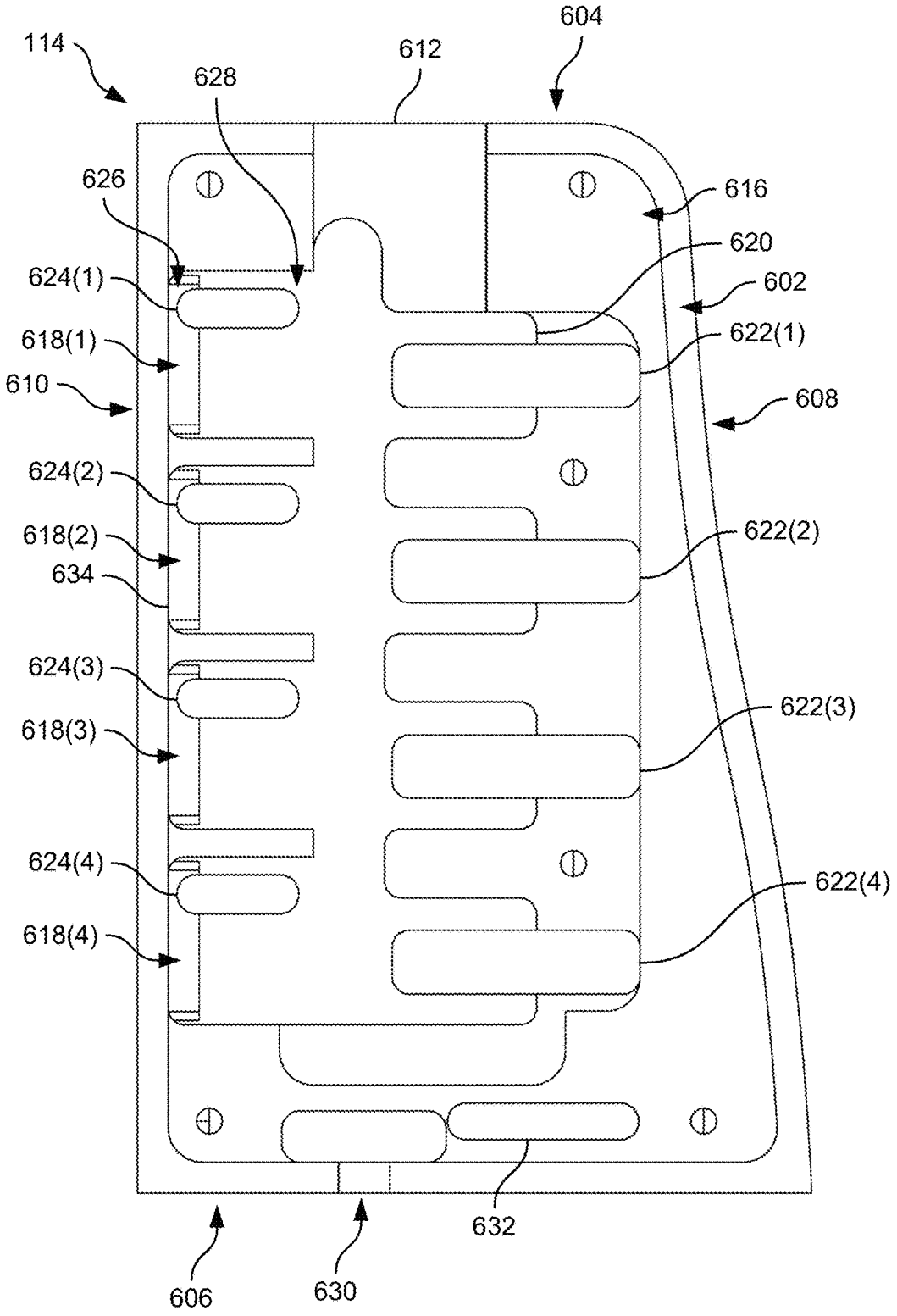
FIG. 6B
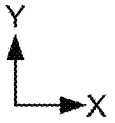

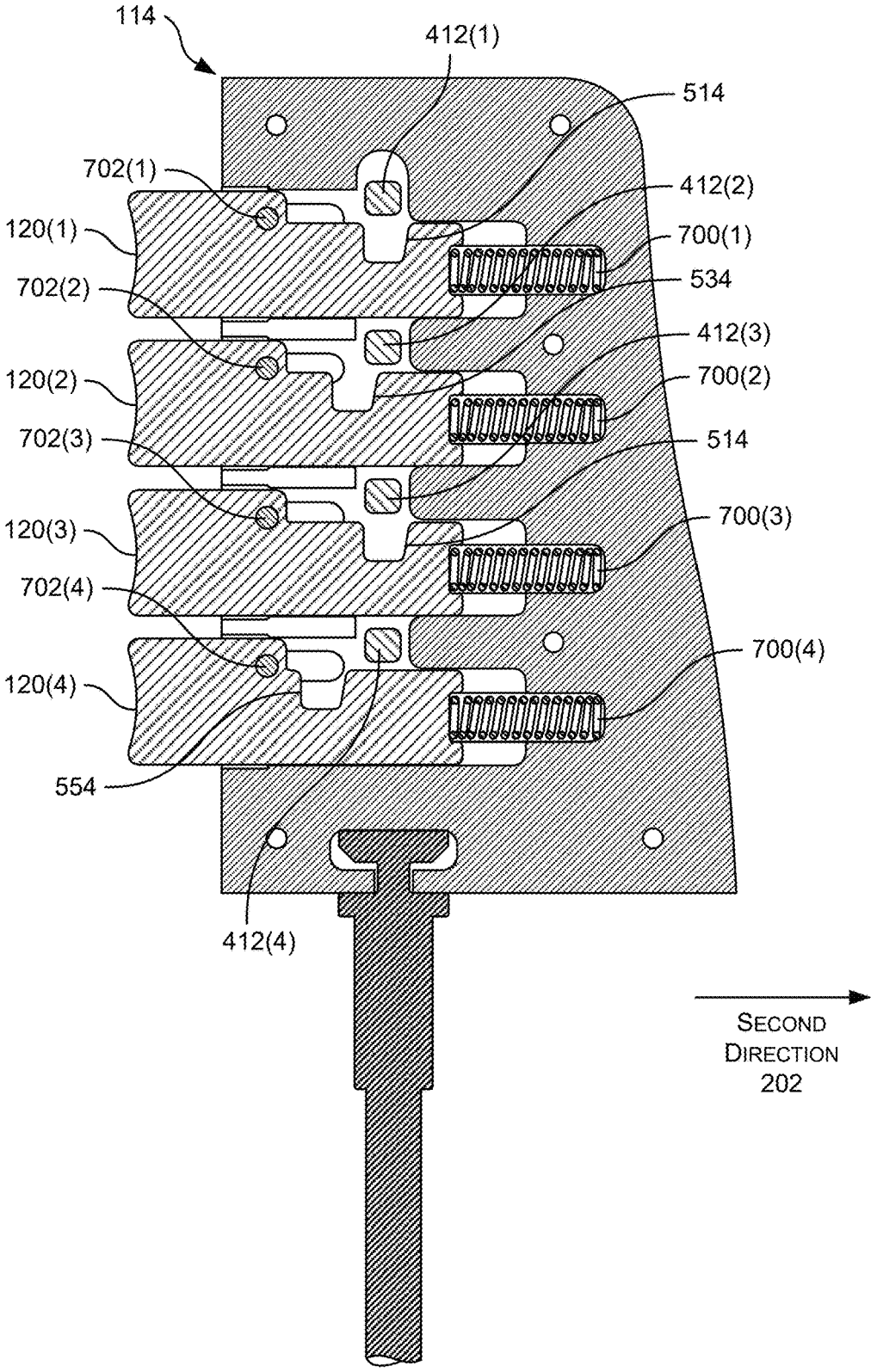
FIG. 7A
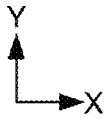

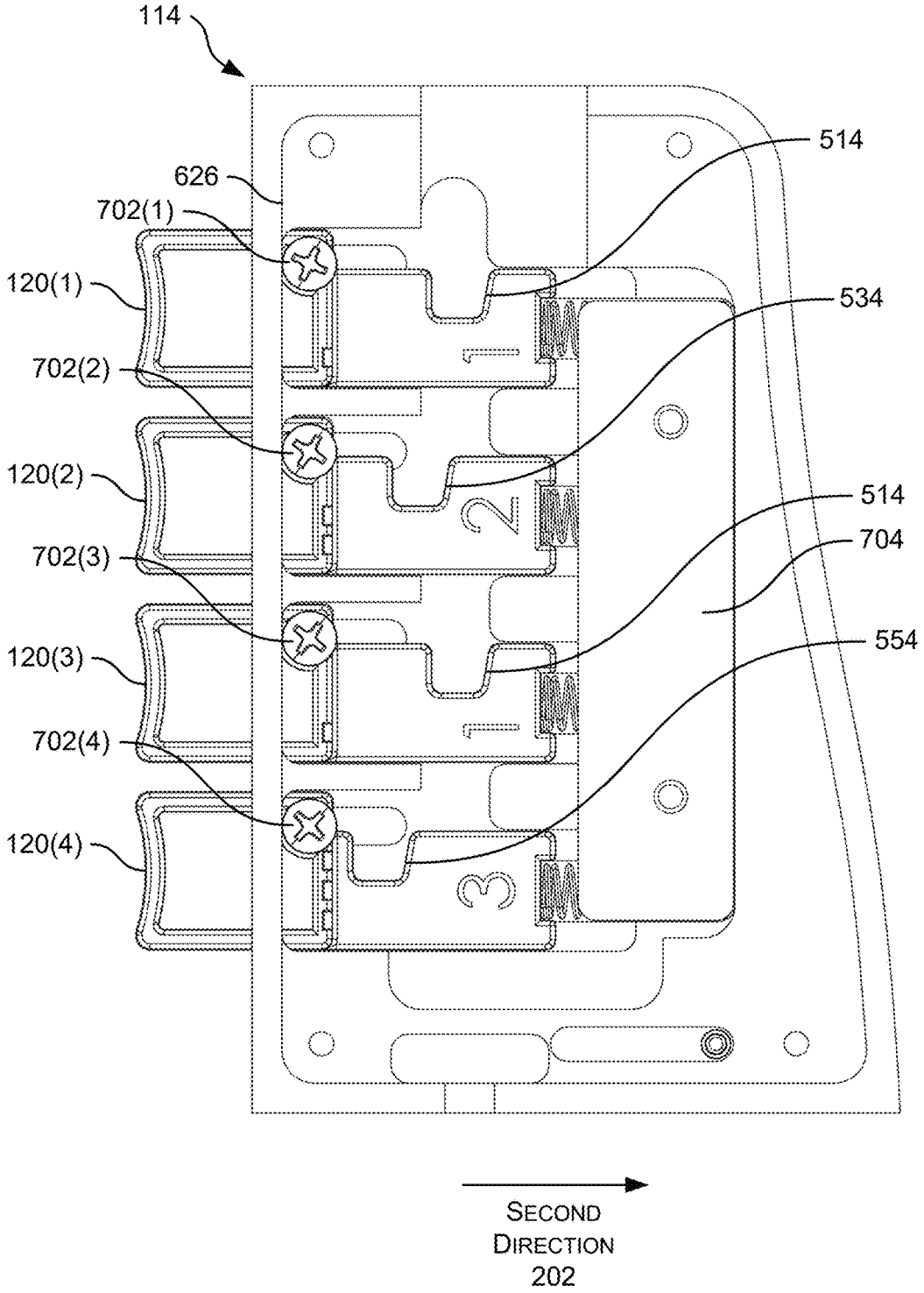
FIG. 7B
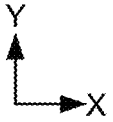

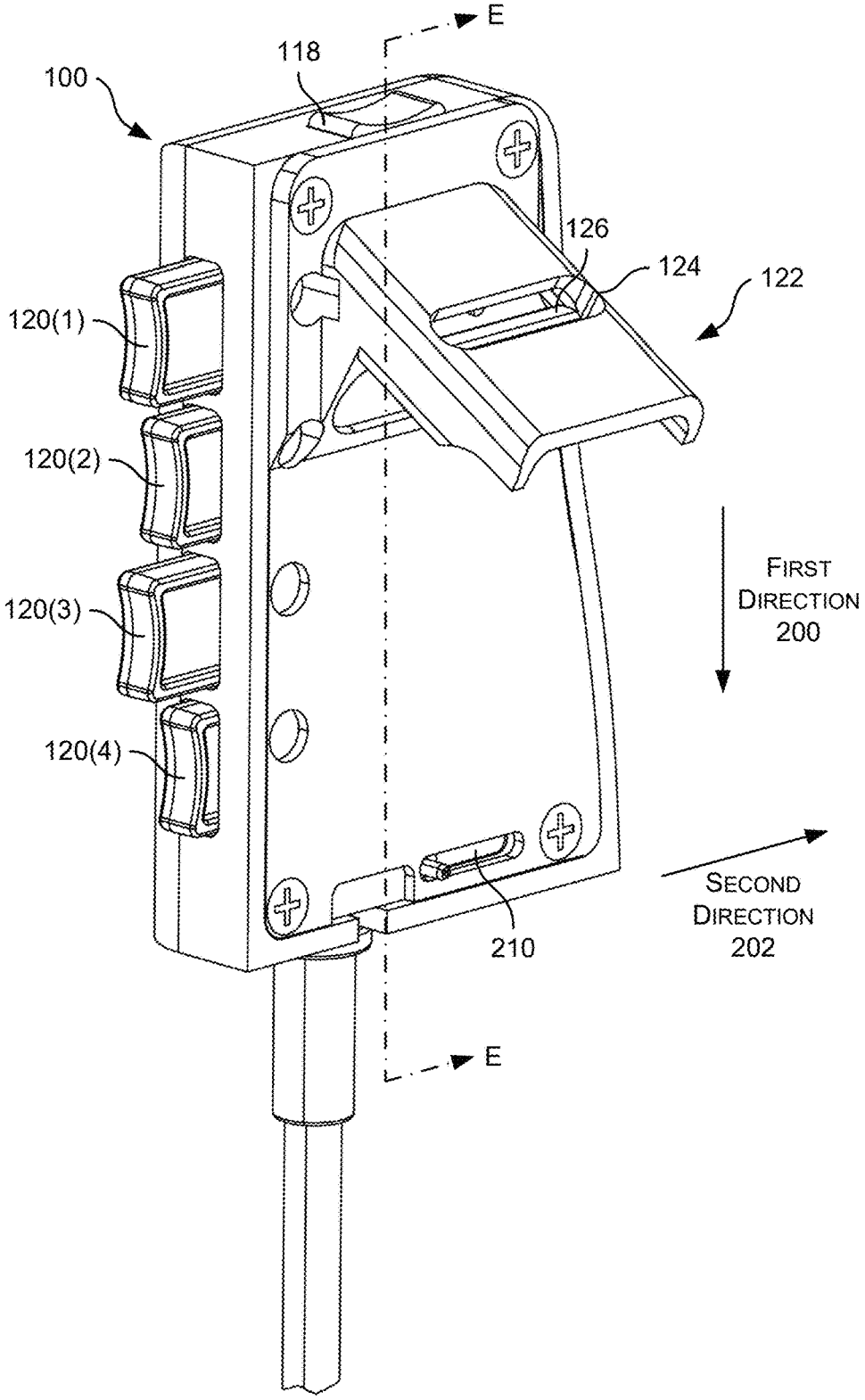
FIG. 9A
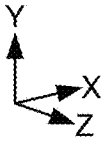

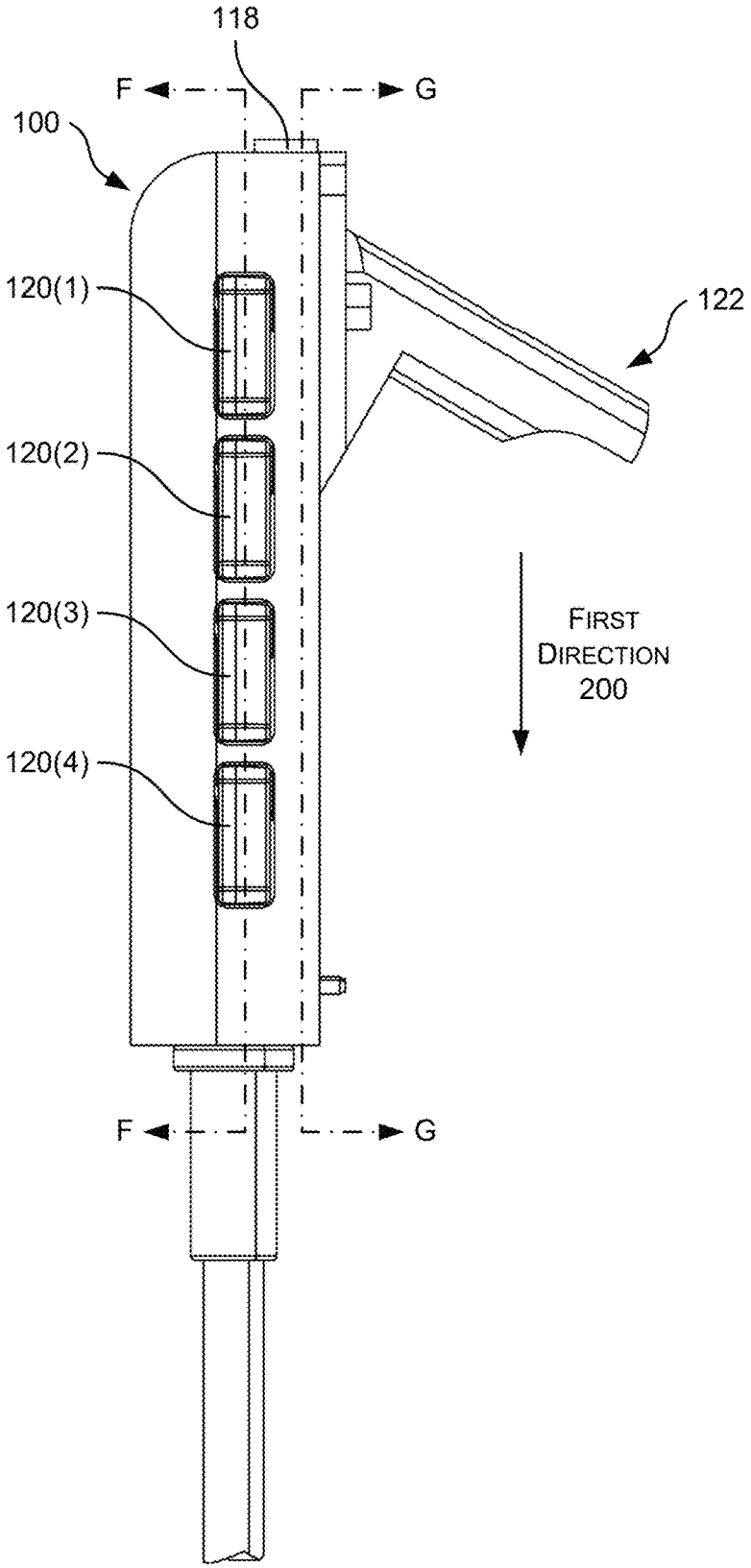
FIG. 9B
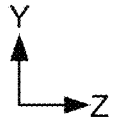

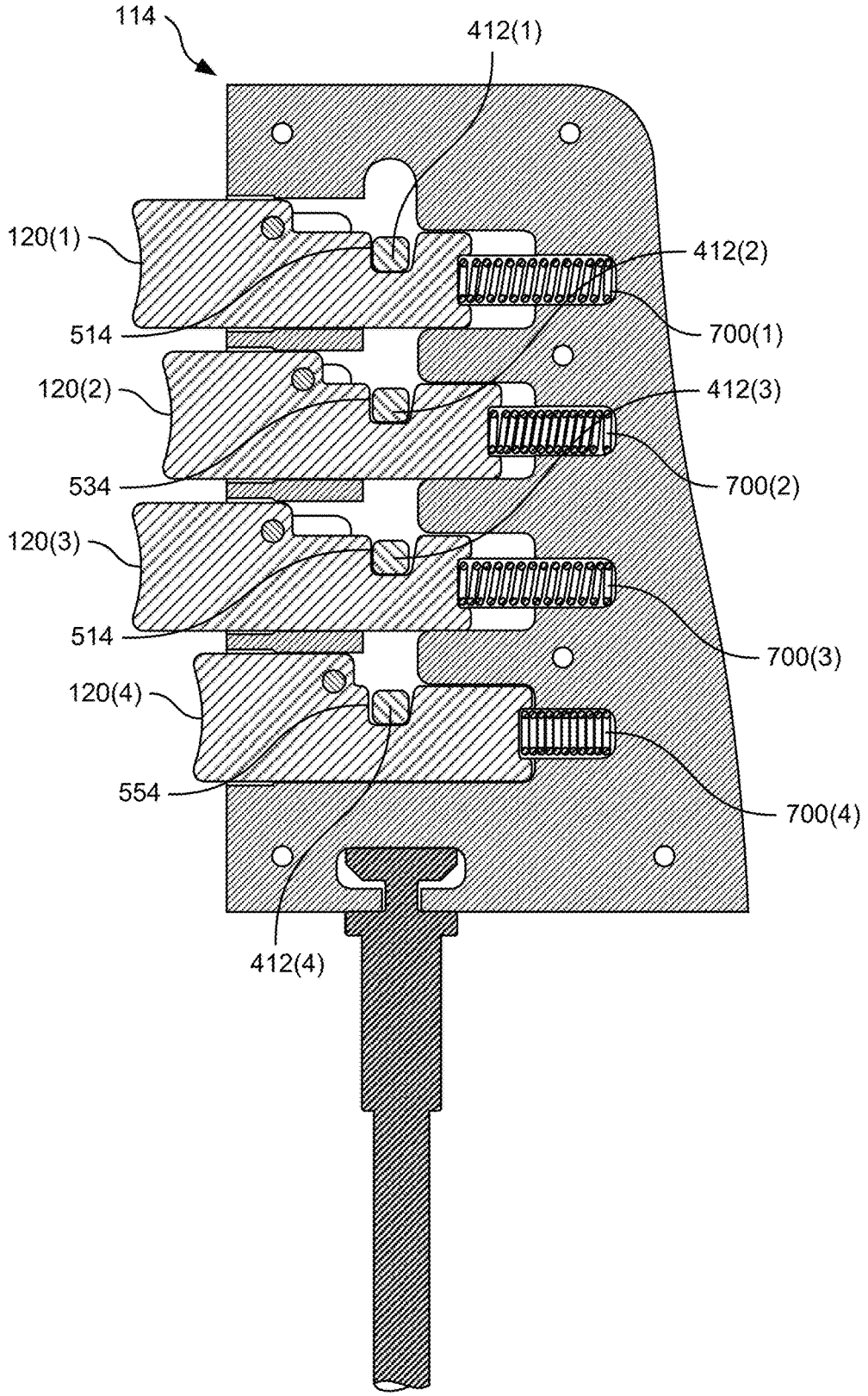
FIG. 10A
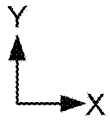

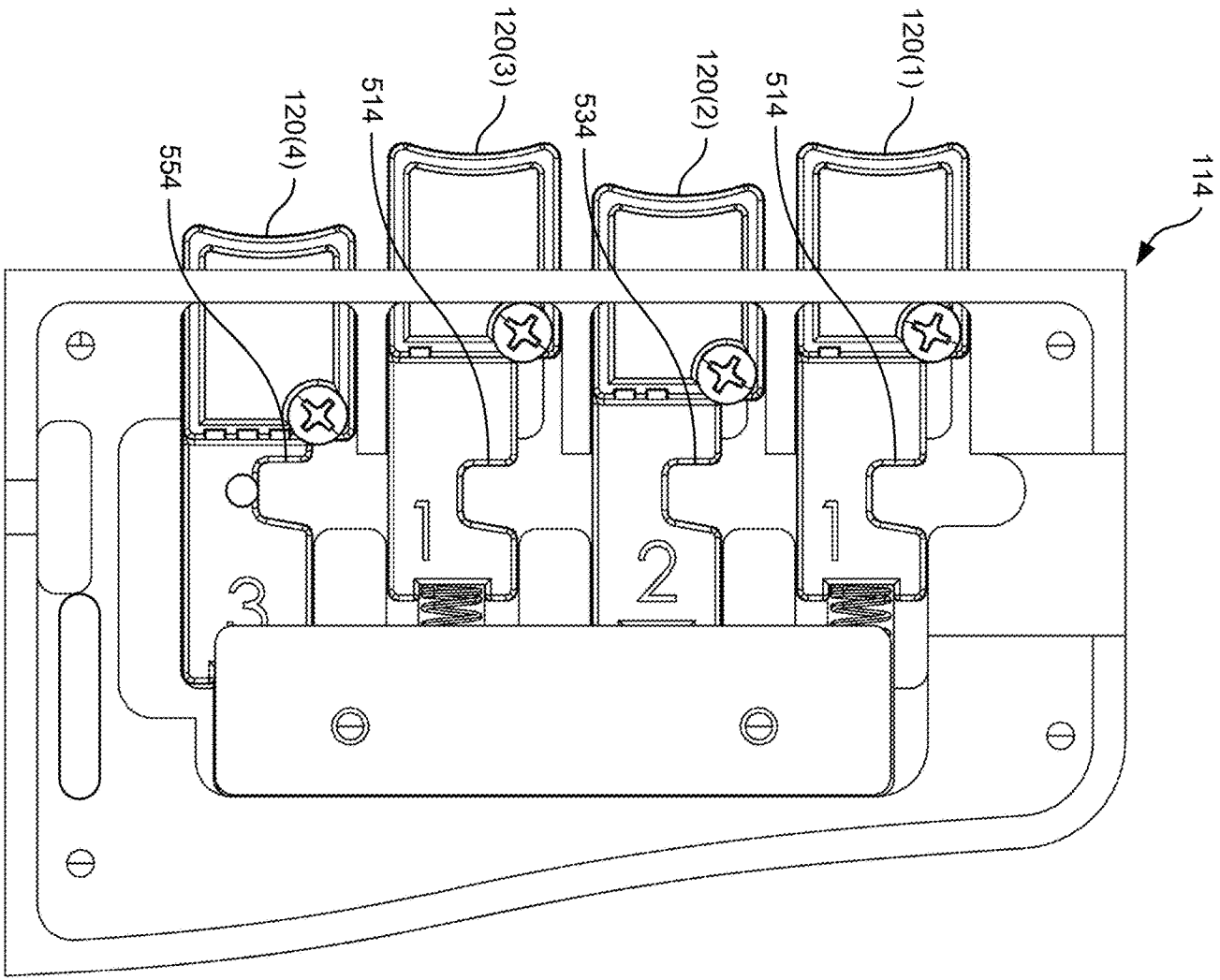
FIG. 10B
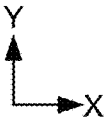

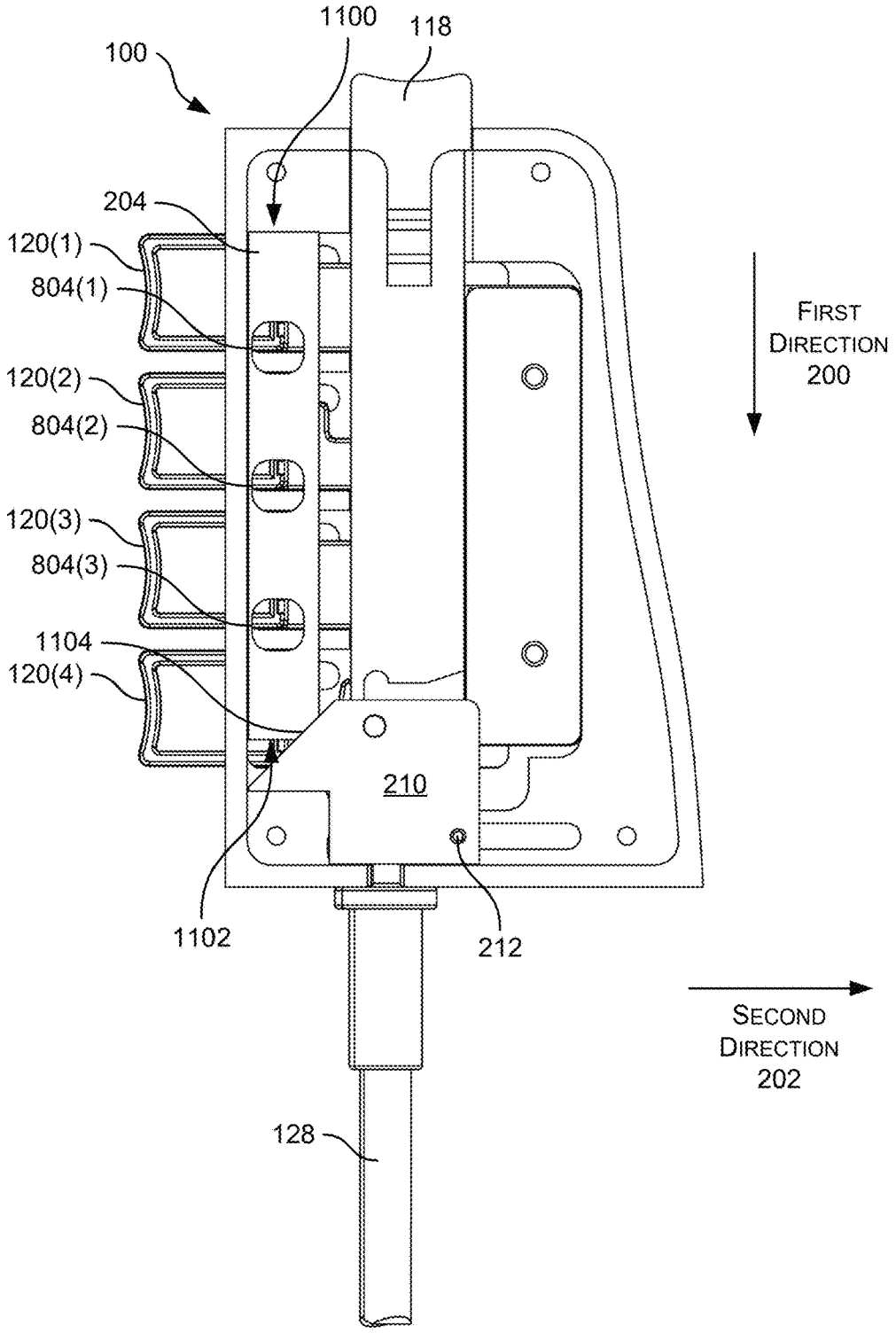
FIG. 11
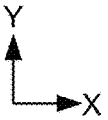

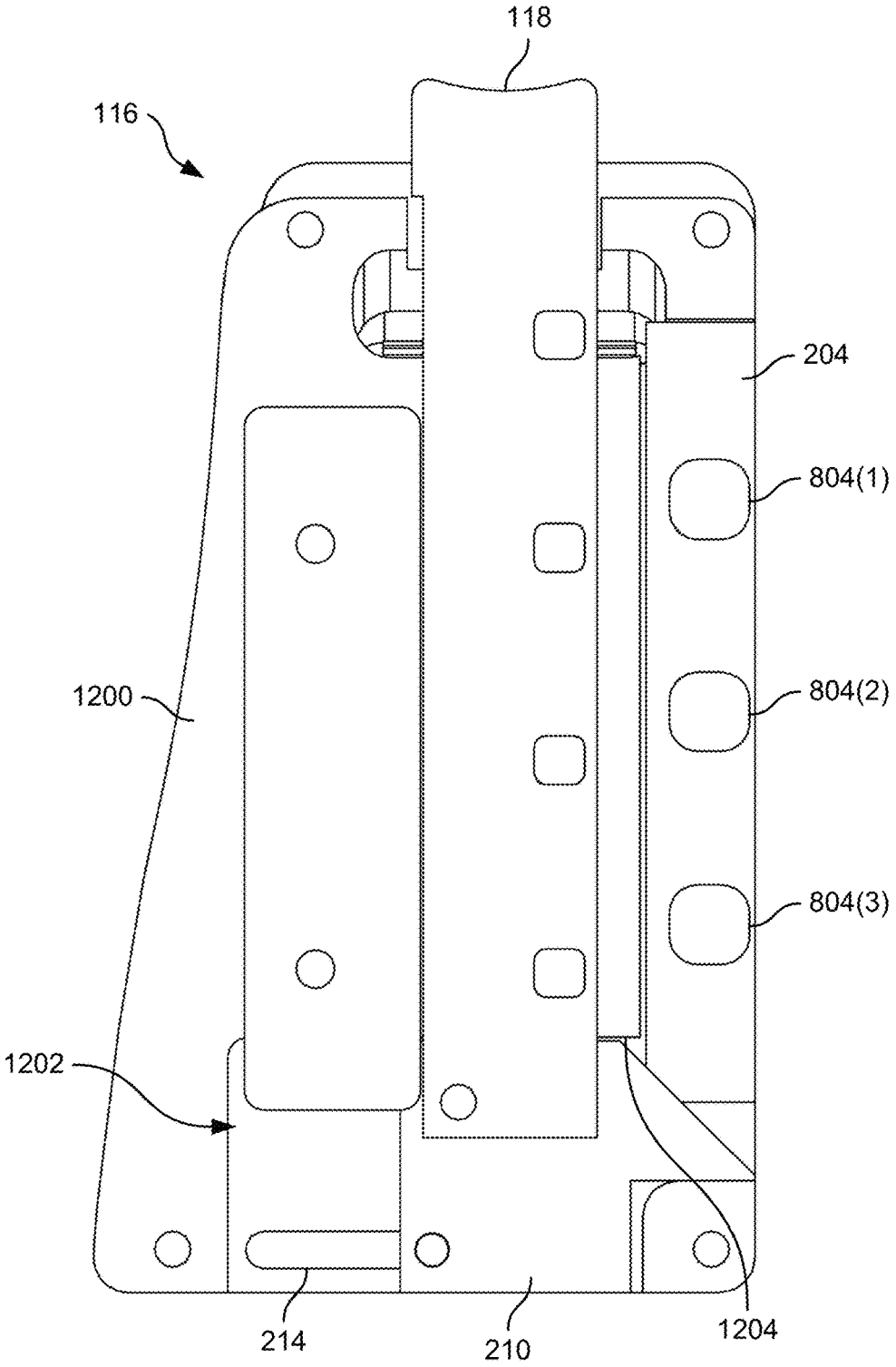
FIG. 12
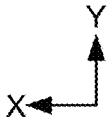

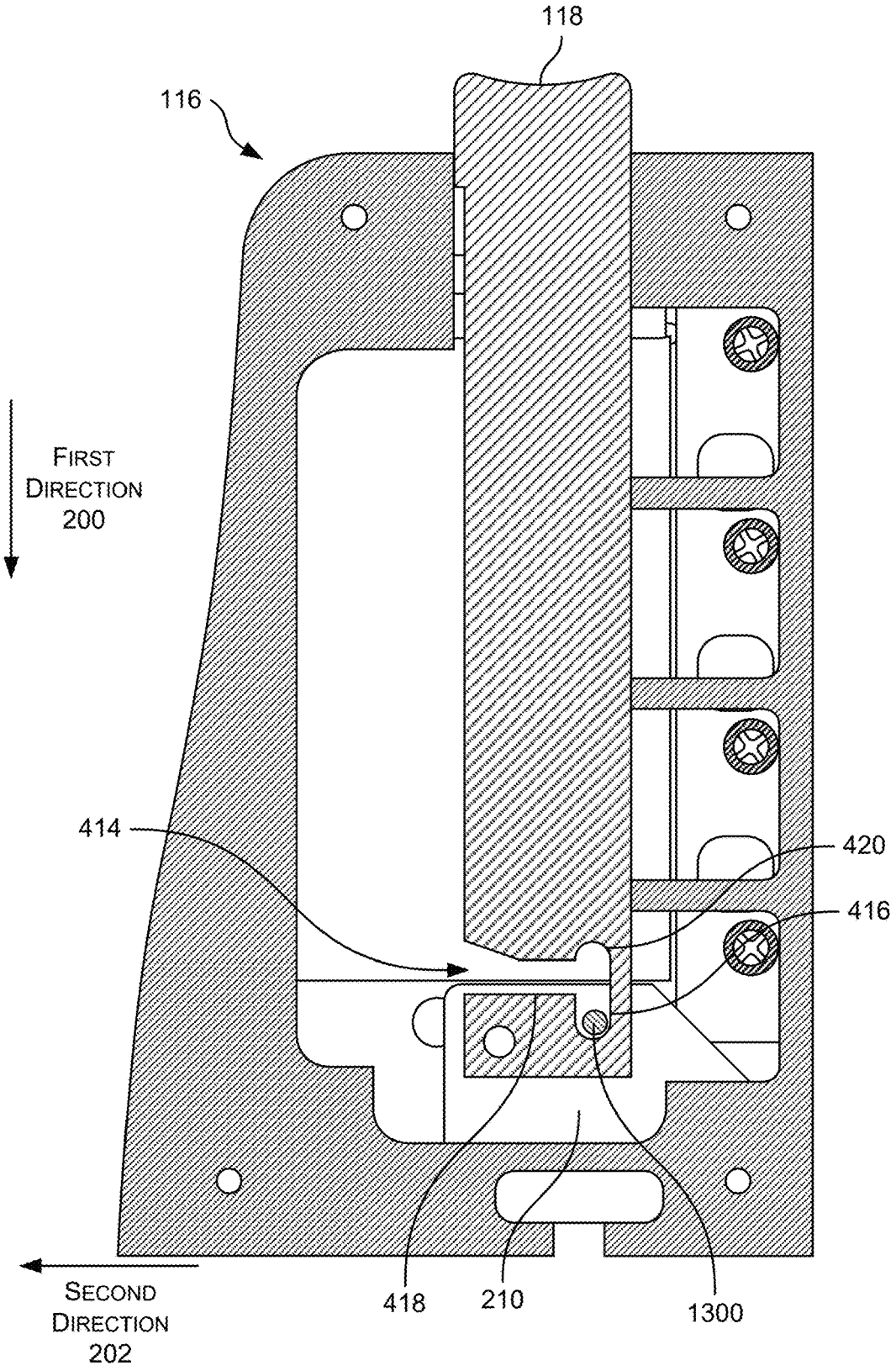
FIG. 13
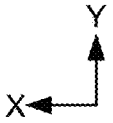

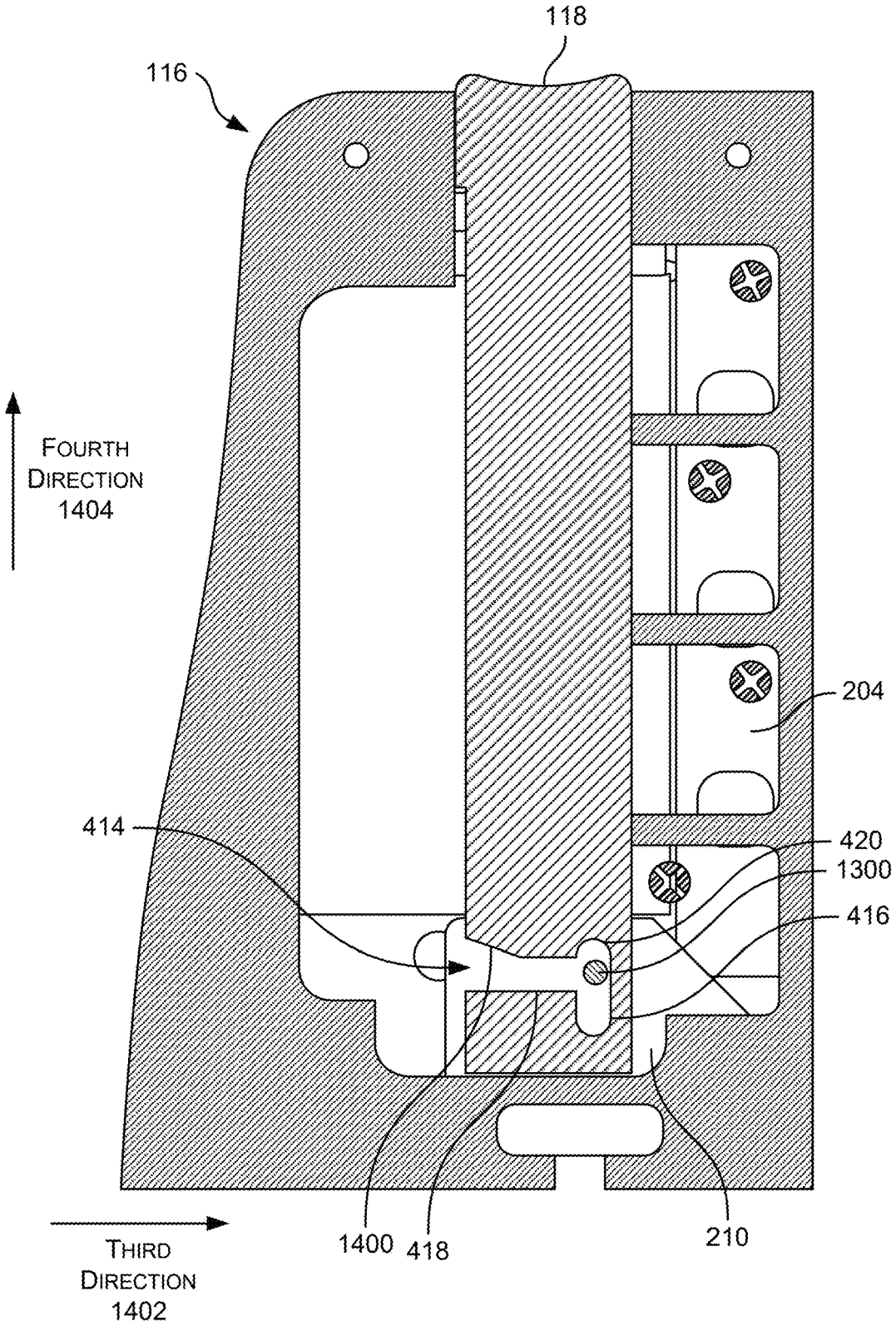
FIG. 14
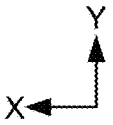

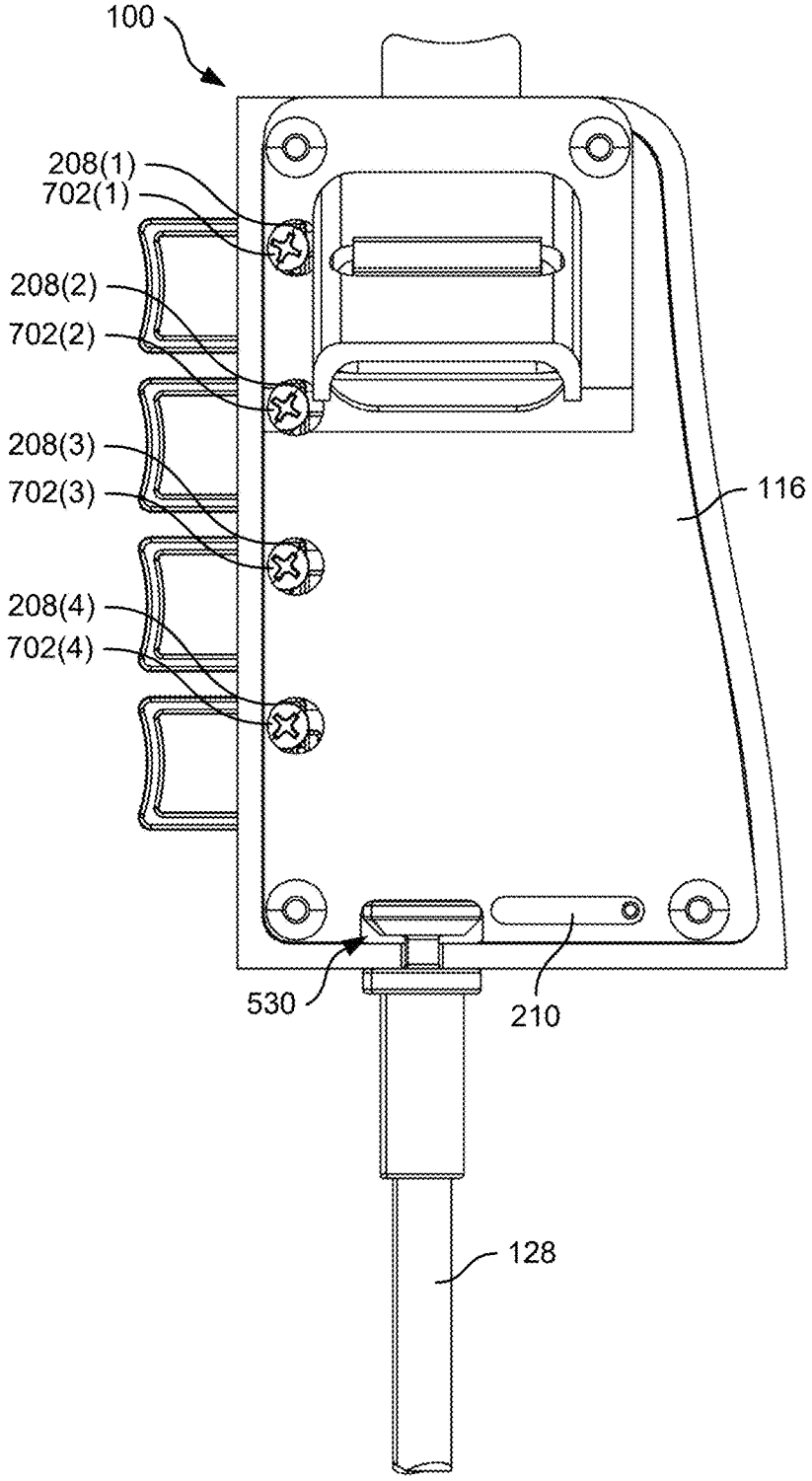
FIG. 15
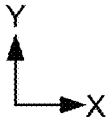

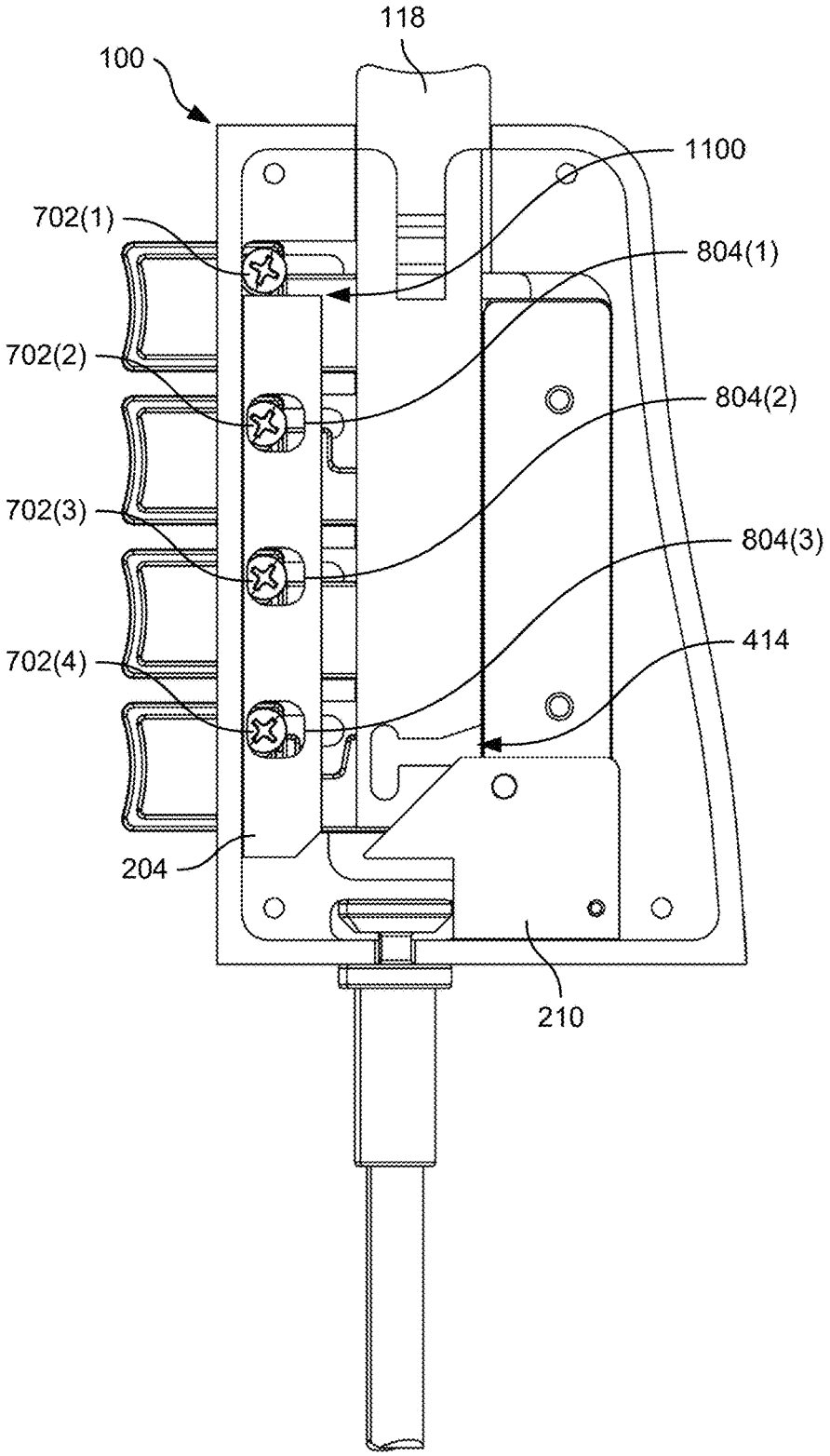
FIG. 16
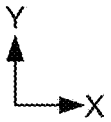

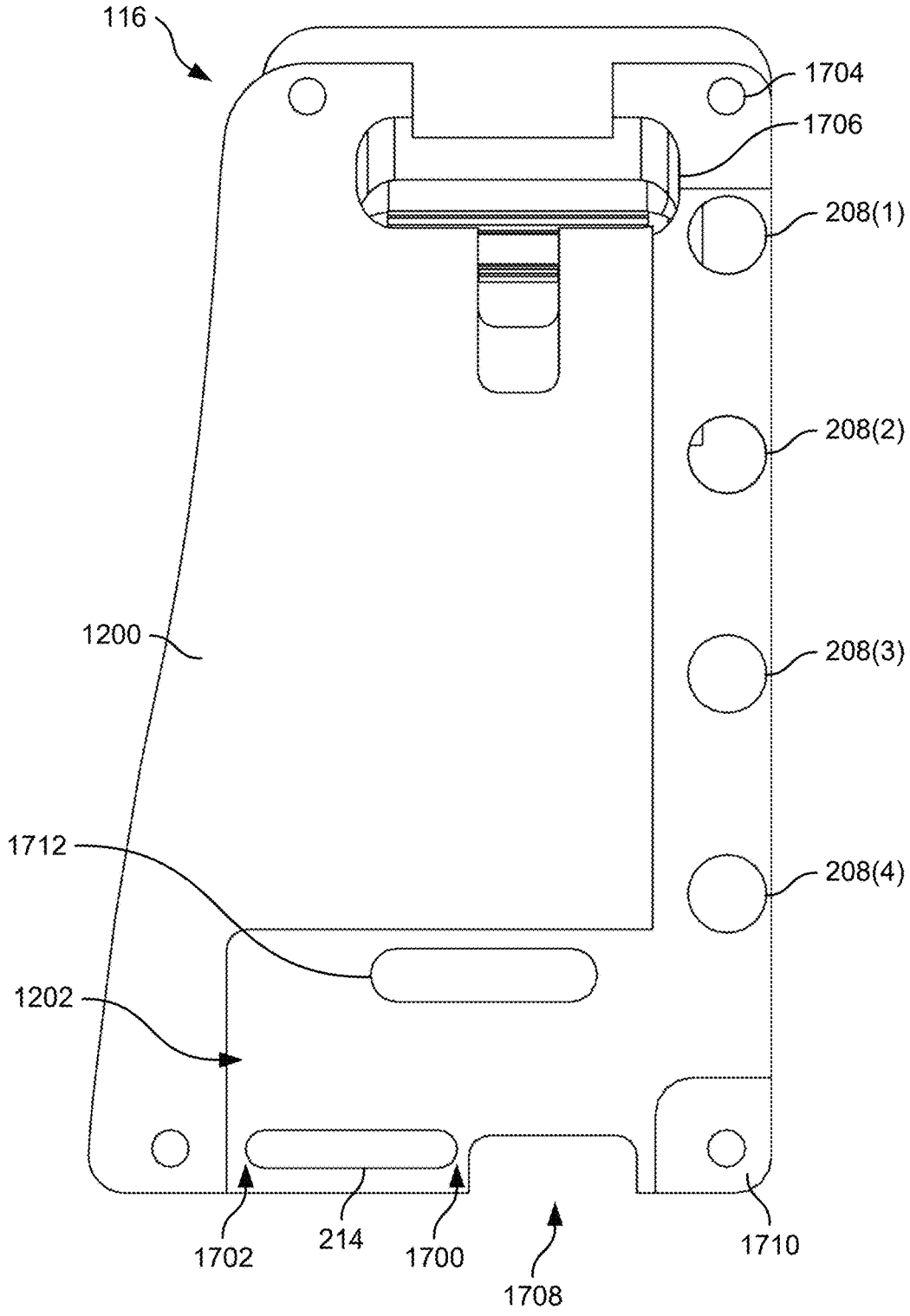
FIG. 17
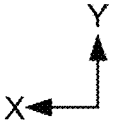

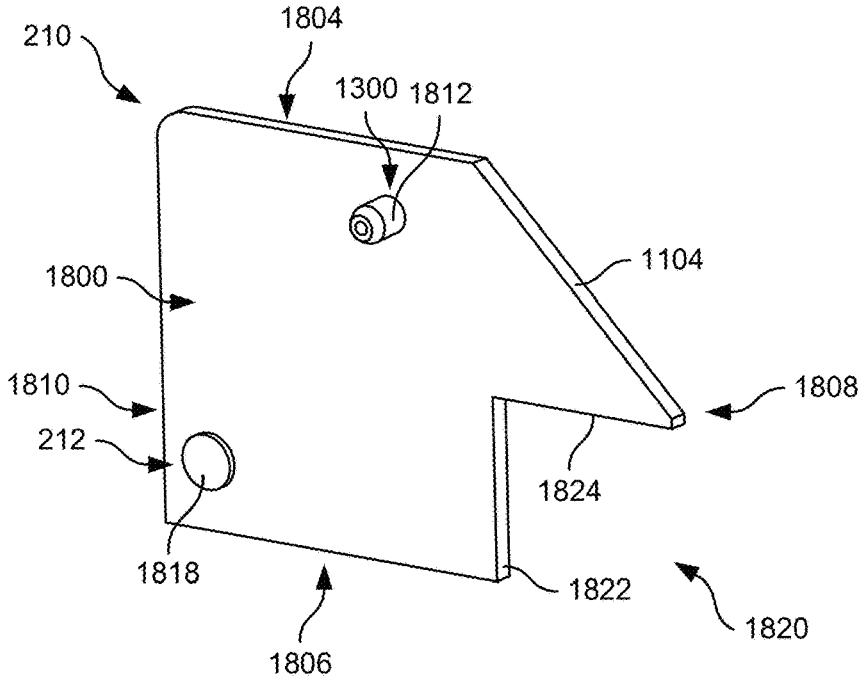
FIG. 18A
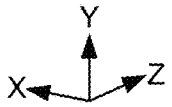
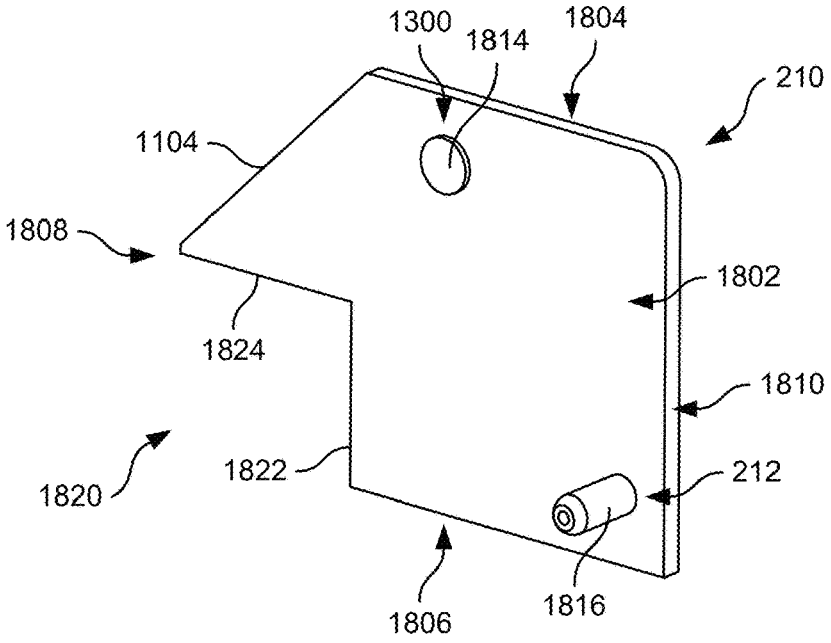
FIG. 18B
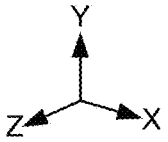

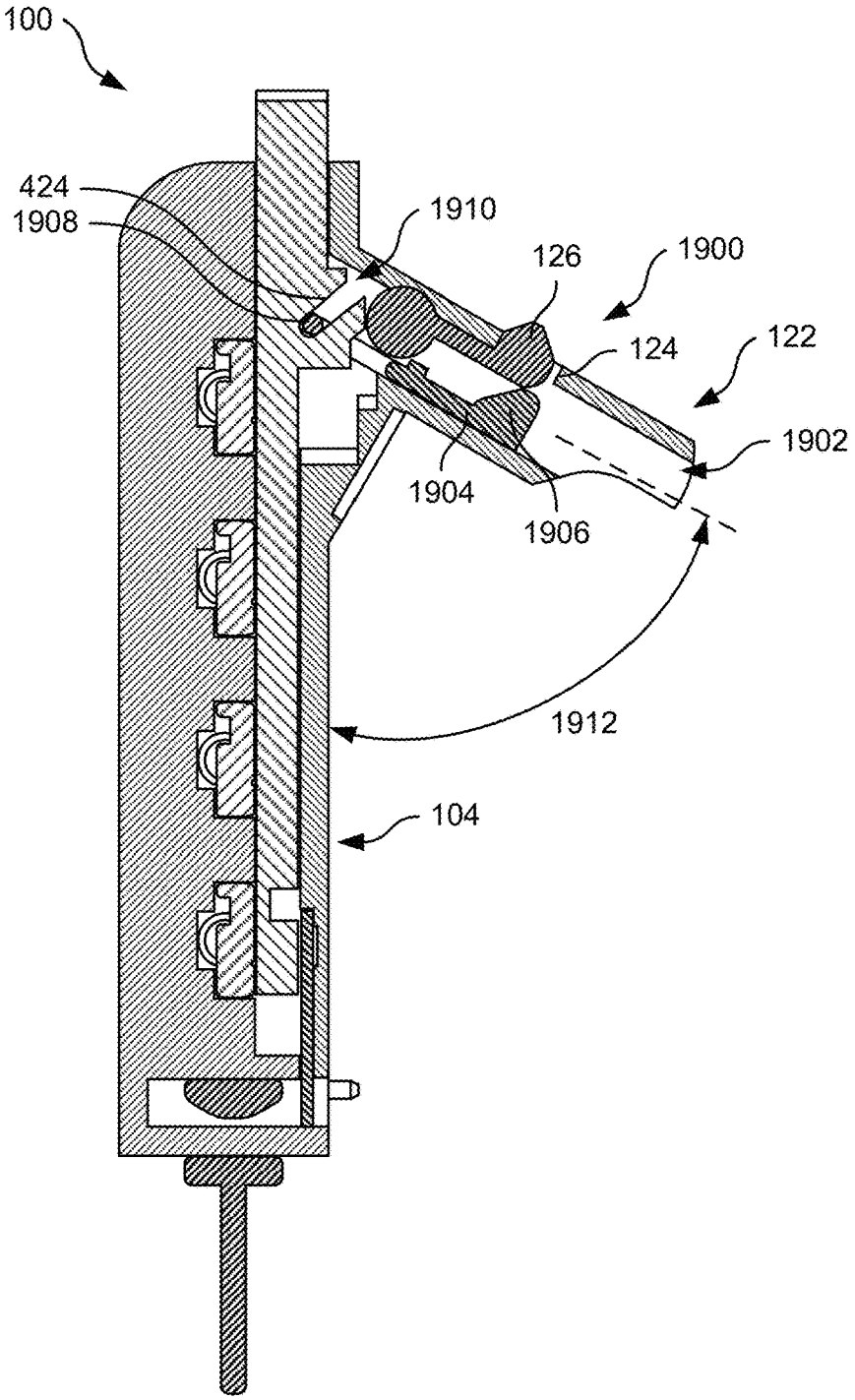
FIG. 19
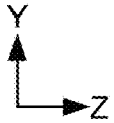

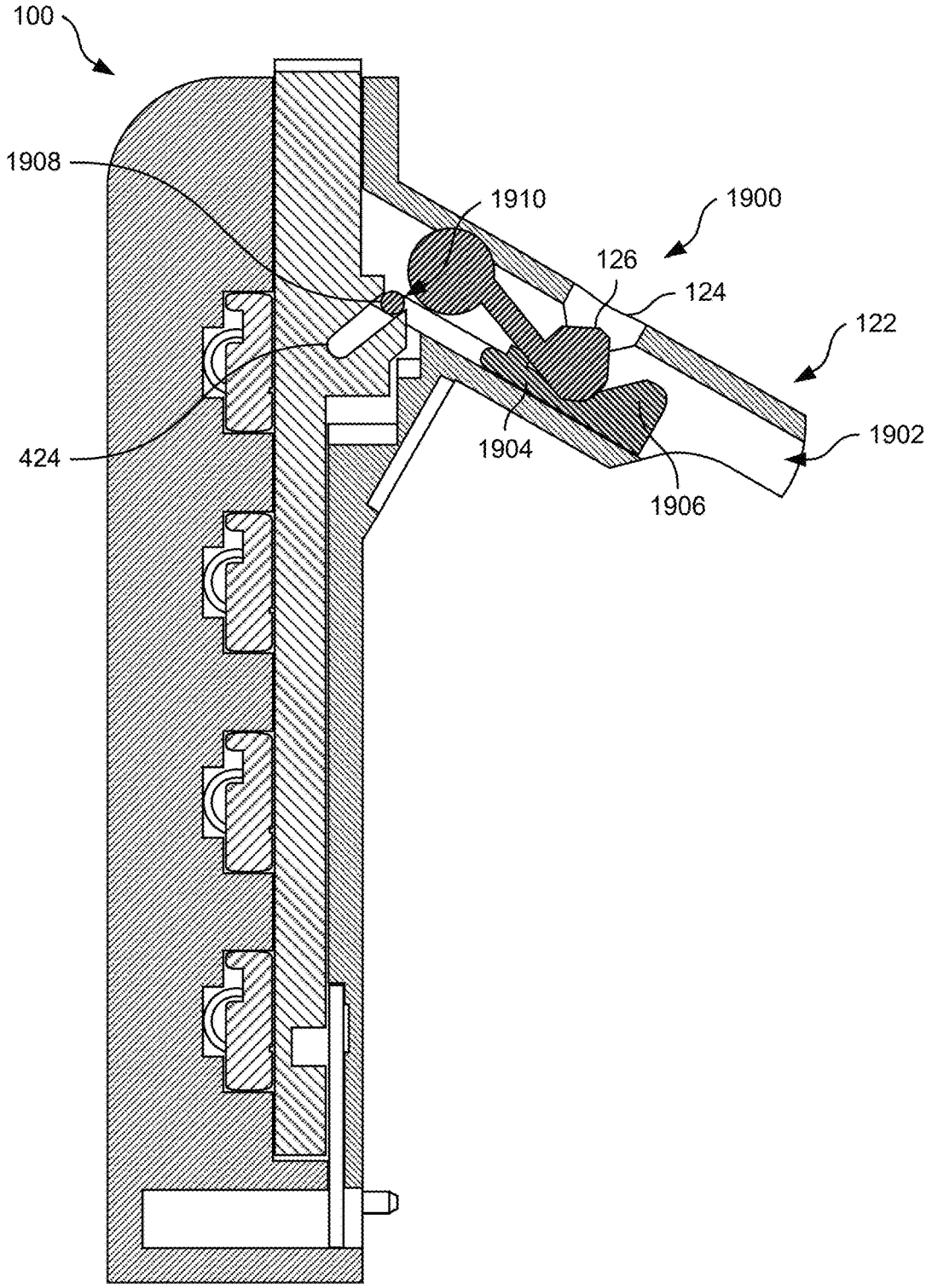
FIG. 20
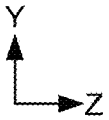

CHAMBER OBSTRUCTION DEVICE FOR FIREARM

BACKGROUND

Valuable personal items that are portable, when not in regular use, are frequently stored for safekeeping within a safe or home vault. For example, firearms are often stored in gun safes to protect against theft, damage, and/or unauthorized use. Additionally, in some instances, firearms may be stored or secured in a way that minimizes their risk of accidental harm, such as in a closet, basement, and/or other locations not readily accessible. However, in times of emergency, storing firearms in gun safes and/or hard-to-reach places may limit their utility. For instance, there may be little time to locate a key and/or enter a security code to unlock a gun safe.

BRIEF DESCRIPTION OF THE DRAWINGS

The detailed description is set forth below with reference to the accompanying figures. In the figures, the left-most digit(s) of a reference number identifies the figure in which the reference number first appears. The use of the same reference number in different figures indicates similar or identical items. The systems depicted in the accompanying figures are not to scale and components within the figures and/or between different figures may be depicted not to scale with each other.

FIG. 1A illustrates a first isometric view of an example chamber obstruction device configured to couple to a firearm, according to examples of the present disclosure.

FIG. 1B illustrates a second isometric view of an example chamber obstruction device configured to couple to a firearm, according to examples of the present disclosure.

FIG. 2 illustrates a back view of the chamber obstruction device of FIGS. 1A and 1B, according to examples of the present disclosure.

FIG. 3 illustrates a side view of the chamber obstruction device of FIGS. 1A and 1B, according to examples of the present disclosure.

FIG. 4A illustrates an isometric view of an example first key of a locking mechanism of the chamber obstruction device of FIGS. 1A and 1B, according to examples of the present disclosure.

FIG. 6A illustrates an isometric view of an example housing of the chamber obstruction device of FIGS. 1A and 1B, according to examples of the present disclosure.

FIG. 6B illustrates a back view of an example housing of the chamber obstruction device of FIGS. 1A and 1B, according to examples of the present disclosure.

FIG. 7A illustrates a cross-sectional view of the chamber obstruction device of FIGS. 1A and 1B, taken along line C-C of FIG. 3, showing an engagement between the first key of FIGS. 4A-4C with the second keys of FIGS. 5A-5C, according to examples of the present disclosure.

FIG. 7B illustrates the second keys of FIGS. 5A-5C disposed within the housing of FIGS. 6A and 6B, according to examples of the present disclosure.

FIG. 9A illustrates an actuation of the first key of FIGS. 4A-4C and the second keys of FIGS. 5A-5C to transition the locking mechanism from a locked state to an unlocked state, according to examples of the present disclosure.

FIG. 9B illustrates an actuation of the first key of FIGS. 4A-4C and the second keys of FIGS. 5A-5C to transition the locking mechanism from a locked state to an unlocked state, according to examples of the present disclosure.

FIG. 10A illustrates a cross-sectional view of the chamber obstruction device of FIG. 1A and FIG. 1B, taken along line F-F of FIG. 9B, showing an actuation of the first key of FIGS. 4A-4C and the second keys of FIGS. 5A-5C to transition the locking mechanism from a locked state to an unlocked state, according to examples of the present disclosure.

FIG. 10B illustrates a position of the second keys of FIGS. 5A-5C in an unlocked state of the locking mechanism, according to examples of the present disclosure.

FIG. 11 illustrates the chamber obstruction device of FIGS. 1A and 1B, showing a lid removed to illustrate example components disposed within an interior of the chamber obstruction device, according to examples of the present disclosure.

FIG. 12 illustrates an example lid of chamber obstruction device of FIGS. 1A and 1B, showing the first key of FIGS. 4A-4C engaged with an example slide and an example cover, according to examples of the present disclosure.

FIG. 13 illustrates a cross-sectional view of the chamber obstruction device of FIGS. 1A and 1B, taken along line D-D of FIG. 3, showing an engagement between the slide of FIG. 12 and the first key of FIGS. 4A-4C in an locked state, according to examples of the present disclosure.

FIG. 14 illustrates a cross-sectional view of the chamber obstruction device of FIG. 1A and FIG. 1B, taken along line G-G of FIG. 9B, showing an engagement between the slide of FIG. 12 and the first key of FIGS. 4A-4C in an unlocked state, according to examples of the present disclosure.

FIG. 15 illustrates example fasteners for interchanging the second keys of FIGS. 5A-5C, according to examples of the present disclosure.

FIG. 16 illustrates the lid of the chamber obstruction device of FIGS. 1A and 1B removed, showing the cover and the slide of FIG. 12 in an unlocked state, according to examples of the present disclosure.

FIG. 17 illustrates an example lid of the chamber obstruction device of FIGS. 1A and 1B, according to examples of the present disclosure.

FIG. 18A illustrates a first isometric view of the slide of FIG. 12, according to examples of the present disclosure.

FIG. 18B illustrates a second isometric view of the slide of FIG. 12, according to examples of the present disclosure.

FIG. 19 illustrates a cross-sectional view of the chamber obstruction device of FIGS. 1A and 1B, taken along line B-B of FIG. 2, showing an example latching mechanism of the chamber obstruction device in a locked state, according to examples of the present disclosure.

FIG. 20 illustrates a cross-sectional view of the chamber obstruction device of FIGS. 1A and 1B, taken along line E-E of FIG. 9A, showing an example latching mechanism of the chamber obstruction device in an unlocked state, according to examples of the present disclosure.

DETAILED DESCRIPTION

Figure 4B:
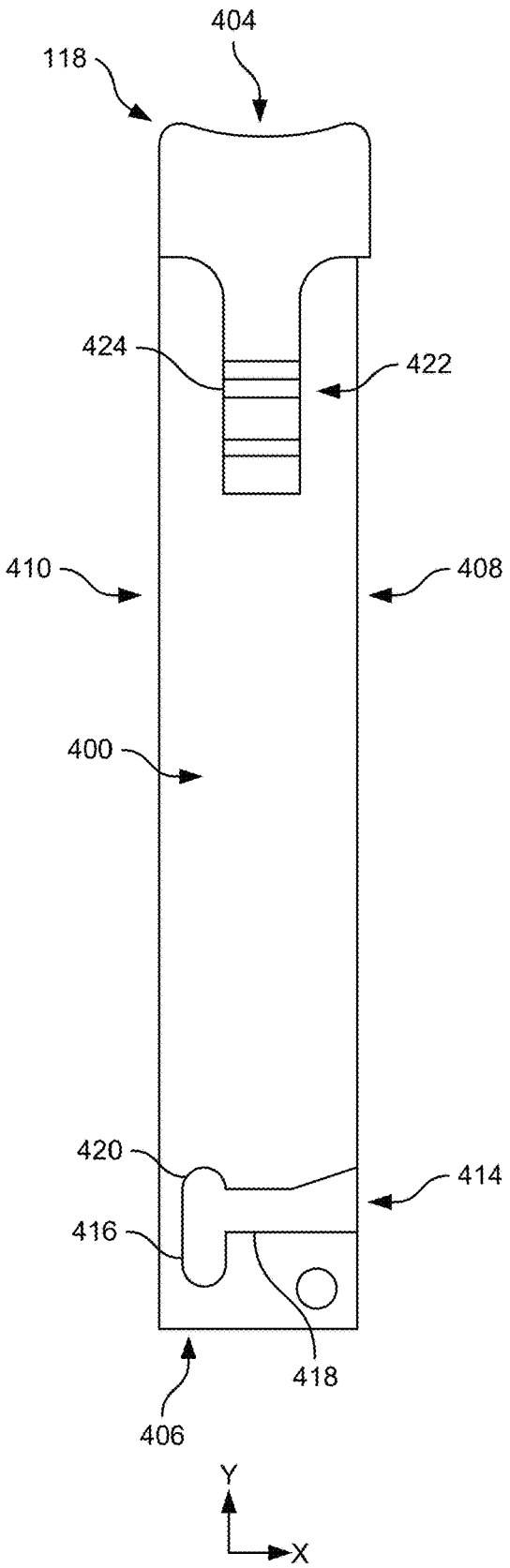
FIG. 4B illustrates a first side view of an example first key of a locking mechanism of the chamber obstruction device of FIGS. 1A and 1B, according to examples of the present disclosure.

This application is directed, at least in part, to a chamber obstruction device configured to be at least partially inserted into a chamber of a firearm, according to examples of the present disclosure. In an embodiment, the chamber obstruction device may obstruct, prevent, restrict, block, etc., a round from entering a barrel of the firearm, prevent a bolt/action of the firearm from closing, and/or obstruct a firing pin reaching a primer of a round. The chamber obstruction device may include a locking mechanism that is actuatable to between a locked state (or position) and an unlocked state (or position). In the unlocked state, the chamber obstruction device may be attachable to the firearm and/or releasable from the firearm. For example, the locking mechanism may include a plurality of actuatable keys that, when actuated by a user in a correct combination and/or order, permits attachment of the chamber obstruction device to the firearm. Additionally, once attached to the firearm, when the plurality of actuatable keys are actuated by the user in the correct combination and/or order, the chamber obstruction device may be released to permit use of the firearm. Accordingly, the chamber obstruction device may prevent an unauthorized and/or uninformed user from using the firearm while simultaneously allowing an authorized and informed user to quickly access the firearm.

In an embodiment, the chamber obstruction device may include a housing and a lid that couples to the housing. As will be explained herein, the housing may define a compartment (e.g., cavity) in which components of the chamber obstruction device are disposed. For example, the locking mechanism may be at least partially disposed in the compartment. The lid may enclose the compartment and/or secure the components to or within the housing.

In an embodiment, the keys of the locking mechanism may represent buttons, latches, levers, slides, or other elements that are capable of being actuated (e.g., pushed, pulled, depressed, slide, etc.) by the user, for example, via manual manipulation (e.g., predetermined action with a user's hand and fingers, etc.). Furthermore, the order and/or combination of keys used to unlock the chamber obstruction device may be set by the user or may be preset by a manufacturer of chamber obstruction device. For example, the user may select a combination of key(s) to be actuated to attach the chamber obstruction device to the firearm, release the chamber obstruction device from the firearm, and so forth. The keys may protrude through respective openings in the housing and/or the lid in order to be actuatable by the user.

In an embodiment, the keys may include at least a first key and one or more second keys. The one or more second keys may operably engage with the first key. For example, the first key may include knobs (e.g., posts, protrusions, pegs, ribs, etc.) and the second keys may include receptacles (e.g., slots, cavities, indents, notches, etc.) into which the knobs of the first key are configured to be disposed. In an embodiment, the first key may represent a master key that is permitted to actuate to unlock the locking mechanism when the correct combination of the one or more second keys has been depressed. In an embodiment, the first key may be actuatable in a first direction when the correct combination of the one or more second keys are depressed. The second keys may be depressible in a second direction that is transverse to the first direction. In other words, the first key may be actuatable in the first direction when the correct combination of the second keys have been depressed in the second direction.

When the correct combination of the one or more second keys are depressed, the knobs of the first key are permitted to move and be disposed in the receptacles of the one or more second keys, respectively. For example, if the locking mechanism includes four of the second keys and the first key includes four of the knobs, when the knobs are respectively aligned with the notches of the second keys, via the correct combination of the second keys being depressed, the first key is actuatable to unlock the locking mechanism. In other words, when the knobs of the first key are permitted to translate within the receptacles of the second keys, the first key is permitted to translate. During an incorrect combination of the second keys, the first key is restricted from actuating because the knobs are not aligned with the receptacles. Given such, the knobs may contact a portion, such as a side, of the second keys external to the receptacles and restrict the first key from translating in the first direction.

In an embodiment, the second keys may include differently located receptacles. For example, along a side of the one or more second keys, the receptacles may be disposed at different locations. In an embodiment, the second keys may include three different types of keys, whereby the receptacles may be disposed at different locations on each of the three different types of keys. The location of the receptacles along the side of the second keys may adjust an amount by which the second keys are depressed in the second direction for aligning with the knobs. For example, for a first type of the second keys, the receptacle may be located at a first location, spaced apart by a first distance from an end of the first type of the second key. For a second type of the second keys, the receptacle may be located at a second location, spaced apart by a second distance from an end of the second type of the second key. For a third type of the second keys, the receptacle may be located at a third location, spaced apart by a third distance from an end of the third type of the second keys. The second distance may be greater than the first distance and the third distance may be greater than the second distance.

The different locations of the receptacles may adjust a combination of the second keys that are depressed to unlock the locking mechanism. In an embodiment, in a resting state, the receptacle of the first type of the second keys may be aligned with a respective knob on the first key. This means that the receptacle of the first type of the second key is already aligned with a corresponding knob on the first key and does not have to be depressed to allow the first key to translate. However, if the first type of the second key is depressed (during an incorrect combination), the receptacle is no longer aligned with the knob and the first key is restricted from translating. For the second type and third type of the second keys, in the resting state, the receptacles may not be aligned with respective knobs on the first key. However, for the second type of the second keys, the receptacle may be aligned with the knob when the second type of second key is depressed halfway (or by a first distance). For the third type of the second keys, the receptacle may be aligned with the knob when the third type of the second key is fully depressed (or by a second distance greater than the first distance). Using a different combination of the second keys, different combinations of the second keys may be used to unlock the locking mechanism. This permits users to change a combination to unlock the locking mechanism and secure the chamber obstruction device to the firearm.

As an example, a first of the second keys may correspond to the first type of the second keys, a second of the second keys may correspond to the second type of the second keys, a third of the second keys may correspond to the first type of the second keys, and a fourth of the second keys may correspond to the third type of the second keys. With this combination, to unlock the locking mechanism, the second of the second keys may be depressed halfway and the fourth of the second keys may be depressed fully. The first and the third of the second keys may not be depressed. In this instance, the receptacles of the second keys may be respectively aligned with the knobs in the first key such that the first key is permitted to actuate in the first direction to unlock the locking mechanism. In other words, a first knob of the first key may be aligned with a first receptacle in the first of the second keys, a second knob of the first key may be aligned with a second receptacle in the second of the second keys, a third knob of the first key may be aligned with a third receptacle in the third of the second keys, and a fourth knob of the first key may be aligned with a fourth receptacle in the fourth of the second keys. Moreover, if the first or the third of the second keys is depressed (whether fully or halfway), even though the second of the second keys is depressed halfway and/or the fourth of the second keys is depressed fully, the knobs may no longer align with all the receptacles and the first key is restricted from translating.

In another example, the one or more second keys may include unlocking keys and locking keys. Unlocking keys are a version of the one or more second keys that inhibit movement of the first key unless and until they are actuated, at which point, the knobs align with the receptacles and the first key is permitted to move in the first direction. In contrast, locking keys are a version of the one or more second keys that do not inhibit movement of the first key when they are in the resting position. However, when a locking key is actuated, the locking key prevents movement of the first key in the first direction.

Although four of the second keys are described, the chamber obstruction device may include more than or less than four of the second keys. In such instances, the first key may include a corresponding number of the knobs for aligning with the receptacles of the second keys. Moreover, although the second keys are described as including three different types of the keys, with differently located receptacles, more than three types of keys may be used.

The second keys may be biased via biasing elements (e.g., springs, gas cylinders, etc.) to provide tactile feedback to the user. The biasing elements may act on the second keys to dispose ends of the second keys external to the housing such that the user may actuate the second keys. In an embodiment, the housing may define races, channels, slots, etc., in which the second keys are configured to translate. In an embodiment, the second keys may be retained within the housing via fasteners. For example, the fasteners may be threaded into the second keys at a location internal to the housing. The fasteners may abut an interior surface of the housing, adjacent to the openings in the housing through which the second keys extend, respectively. To interchange the second keys with one another (e.g., to adjust a combination), the fasteners may be removed. When removed, the second keys may be pulled out the openings, respectively. Therein, another second key may be replaced, and the fasteners may be threaded into the second key to secure the second key to or within the housing.

In an embodiment, once the locking mechanism is transitioned to the unlocked state, if the first key is released, the locking mechanism may transition back to the locked state. For example, the biasing elements may urge against the second keys, which in turn, may urge against the first key. If the first key is released by the user, the second keys may engage with the first key to return the first key to a resting position. Here, the locking mechanism is in the locked state. However, maintaining a force on the first key restricts movement of the first key to the resting state and maintains the locking mechanism in the unlocked state. As such, the first key may have to remain depressed, in the unlocked state.

In an embodiment, the chamber obstruction device includes a cover that exposes the fasteners to permit the user to interchange the second keys. The cover may be moveable between a first position in which access to the fasteners are restricted (e.g., obstructed, covered, etc.) and a second position in which access to the fasteners are permitted (e.g., unobstructed, uncovered, etc.). In an embodiment, the fasteners may be accessible through apertures disposed in the lid and the cover. In the first position, the apertures in the cover may not be aligned with apertures in the lid, thereby restricting access to the fasteners. However, in the second position, the apertures in the cover may be aligned with the apertures in the lid, thereby permitting access to the fasteners.

In an embodiment, the cover may be permitted to translate (e.g., slide, move, etc.) between the first position to the second position when the locking mechanism is in the unlocked state. In an embodiment, a slide may be actuatable when the locking mechanism is unlocked to permit the cover to move between the first position to the second position. For example, when the locking mechanism is in the unlocked state, the slide may be actuated to permit the cover to move from first position in which the fasteners are obstructed to the second position in which the fasteners are unobstructed. When the second keys are interchanged, the slide may be actuated to move the cover from the second position to the first position.

In an embodiment, the slide may include a handle (e.g., knob, protrusion, knuckle, etc.) that is actuatable within a slot of the lid. The handle may move within the slot during actuation of the slide. In an embodiment, the slide may move within the slot, between a first position and a second position. In the first position of the slide, the cover is restricted from moving from the first position to the second position. In the second position of the slide, the cover is permitted to move from the first position to the second position.

The slide may also control access to a tether (e.g., cable, wire, etc.) that may be used to secure the firearm. In an embodiment, the tether may prevent the firearm from unauthorized transport. For example, the tether may be secured to locks, structures (e.g., legs of furniture), posts, etc. In an embodiment, the housing may include a receptacle that receives an end of the tether. In the first position of the slide, the end of the tether may be retained within the receptacle. For example, in the first position of the slide, the slide may prevent the end of the tether from being pulled out of the receptacle. However, when the slide moves to the second position, the slide may no longer prevent the end of the tether being pulled out of the receptacle.

In an embodiment, the first key includes a channel in which a pin (e.g., knob, peg, protrusion, etc.) of the slide is disposed. When the locking mechanism is in the locked state, the pin may be restricted from moving within the channel and, consequently, prevent the slide from moving to the second position. Comparatively, when the locking mechanism is in the unlocked state, the pin is permitted to move within and/or out of the channel. Correspondingly, the slide may move to the second position.

The chamber obstruction device includes a latching mechanism that secures the chamber obstruction device to the firearm. For example, the lid may include a flange having an aperture through which a latch of the latching mechanism is disposed. A portion of the flange may be insertable into the chamber and while inserted in the chamber, the latch protrudes through the aperture to lock the chamber obstruction device to the firearm. More particularly, the latch may engage with an interior of the chamber to prevent the chamber obstruction device being removed from the firearm. The latching mechanism may therefore be actuatable via the first key, or more generally, the locking mechanism.

In an embodiment, the locking mechanism may be in the unlocked state for the flange to be insertable into the chamber and have the latch engage with the interior of the chamber. For example, when the locking mechanism is in the unlocked state and the first key is depressed, the flange may be disposable within the chamber. Once inserted, the first key may be released and the locking mechanism may transition to the locked state. When the locking mechanism transitions to the locked state the latch protrudes through the aperture. When the latch protrudes through the aperture, the latch engages with the interior of the chamber. To release the chamber obstruction device from the firearm, the locking mechanism may transition to the unlocked state, thereby retracting the latch within the aperture, and permitting the flange to be removed from the firearm.

Although referred to herein as "keys," the first key and the second keys may be representative of other members, fingers, bars, struts, etc., that are actuatable, depressible, moveable, etc. For example, the first key and/or the second keys may be referenced as depressible members that are depressible via application of a force from a user. Moreover, although the second keys are described as being secured to the housing via fasteners, other fastening mechanisms (e.g., pins) may be used to secure the second keys to the housing. In such instances, the fastening mechanisms may be obstructed and unobstructed via movement of the cover.

The chamber obstruction device may be used with any suitable firearm, such as a pistol, rifle, etc. The functionality and sizing of the chamber obstruction device may be scaled to accommodate the firearm. By way of example, the chamber obstruction device may be sized to engage a chamber of an AR-15 rifle chambered for either .223 REM or 5.56 NATO, a .22 rifle, a .308 rifle, a shotgun of varying gauges, pistols of varying calibers, etc. The chamber obstruction device may be manufactured from a plurality of materials, including but not limited to plastics (e.g., Polycarbonate-ABS), metals (e.g., Aluminum), composites, or any combination thereof. The materials from which the storage container is manufactured may be strong, durable, resilient, impact-proof, and withstand forced entry. Suitable manufacturing techniques may include milling, injection molding, casting, etc.

The present disclosure provides an overall understanding of the principles of the structure, function, device, and system disclosed herein. One or more examples of the present disclosure are illustrated in the accompanying drawings. Those of ordinary skill in the art will understand that the devices and/or the systems specifically described herein and illustrated in the accompanying drawings are non-limiting embodiments. The features illustrated or described in connection with one embodiment may be combined with the features of other embodiments. Such modifications and variations are intended to be included within the scope of the appended claims.

FIGS. 1A and 1B illustrate an example chamber obstruction device 100 that may be used to secure a firearm, according to examples of the present disclosure. FIG. 1A illustrates an isometric view of a front 102 of the chamber obstruction device 100, and FIG. 1B illustrates a back 104 of the chamber obstruction device 100, spaced apart from the front 102 (e.g., in the Z-direction). When secured to the firearm, the front 102 may be oriented in a direction away from the firearm while the back 104 may be oriented in a direction towards the firearm. The chamber obstruction device 100 may include a first side 106 and a second side 108 spaced apart from the first side 106 (e.g., in the X-direction). The chamber obstruction device 100 may also include a top 110 and a bottom 112 spaced apart from the top 110 (e.g., in the Y-direction).

The chamber obstruction device 100 includes a housing 114 and a lid 116 that couples to the housing 114. The lid 116 may couple to the housing 114 at a location along the back 104. As will be explained herein, the chamber obstruction device 100 may include a locking mechanism having one or more actuatable keys. For example, the locking mechanism may include a first key 118 and one or more second keys 120, such as a second key 120(1), a second key 120(2), a second key 120(3), and a second key 120(4). The first key 118 and the second keys 120 may be disposed through respective openings in the housing 114. Although the chamber obstruction device 100, or the locking mechanism, is described as including four of the second keys 120, more than or less than four of the second keys 120 may be included. The first key 118 may be disposed along the top 110 and/or the second keys 120 may be disposed along the second side 108.

The first key 118 and the second keys 120 may represent buttons, latches, levers, members, slides, or other elements that are capable of being actuated (e.g., pushed, pulled, depressed, slide, etc.) by a user, for example, via manual manipulation (e.g., predetermined action with a user's hand and fingers, etc.). The arrangement of the first key 118 and the one or more second keys 120 may permit a user to easily orient their hand on the chamber obstruction device 100.

In FIGS. 1A and 1B, none of the first key 118 or the second keys 120 are shown depressed. In an embodiment, the first key 118 may be actuated via a thumb of the user, while the second keys 120 may be actuated via fingers of the user. In an embodiment, the first key 118 may represent a master key that is permitted to actuate to unlock the locking mechanism when the correct combination of the second keys 120 are depressed. For example, as shown, the second keys 120 may include four keys, however, not all of the second keys 120 may be actuated to unlock the locking mechanism. With this, a user may desire a certain combination of the second keys 120 to be pressed in order to unlock the locking mechanism and release the chamber obstruction device 100 from the firearm. When the correct combination of the second keys 120 are depressed, the first key 118 is permitted to be depressed. Conversely, if the incorrect combination of the second keys 120 is actuatable, the first key 118 is restricted from being depressed.

For example, the second keys 120 may operably engage with the first key 118 within the housing 114. The first key 118 may include knobs and the second keys may include receptacles into which the knobs of the first key 118 are configured to be disposed. When the correct combination of the one or more second keys 120 are depressed, the knobs of the first key 118 are permitted to move and be disposed in the receptacles of the second keys, respectively. During an incorrect combination of the second keys 120, the first key 118 is restricted from actuating because the knobs are not aligned with the receptacles. Different types of the second keys 120 may have differently located receptacles such that the second keys are depressible by different amounts, or no amount at all, to align the receptacles with the knobs and permit actuation of the first key 118. In an embodiment, the second keys 120 may be depressed by different lengths (e.g., halfway, fully, one-third, etc.) for the correct combination to the entered that permits the first key 118 to be actuated. The user may interchange the second keys 120 with one another to change an unlocking combination of the second keys 120. That is, interchanging the second keys 120 adjusting a correct combination of the second keys 120 that are depressed to unlock the locking mechanism.

The locking mechanism may transition between a locked state and an unlocked state. In the locked state, the chamber obstruction device 100 may be secured to the firearm, whereas in the unlocked state, the chamber obstruction device 100 may be removed from the firearm. When the first key 118 is permitted to translate, the locking mechanism may transition from the locked state to the unlocked state. In FIGS. 1A and 1B, the locking mechanism is shown in the locked state.

The lid 116 may include a flange 122 having an aperture 124 through which a latch 126 is disposed. The flange 122 may be at least partially insertable into a chamber of the firearm, and while inserted in the chamber, the latch 126 protrudes through the aperture 124 to lock the chamber obstruction device 100 to the firearm. When the flange 122 is disposed in the chamber, the chamber obstruction device 100 may obstruct, prevent, restrict, block, etc., a round from entering a barrel of the firearm, prevent a bolt/action of the firearm from closing, and/or obstruct a firing pin reaching a primer of a round. When the locking mechanism is in the unlocked state the latch 126 recedes within the aperture 124. This permits the flange 122 to be pulled out of the chamber.

The chamber obstruction device 100 may additionally include a tether 128 that secures the firearm. As will be explained herein, the tether 128 may be removably coupled to the chamber obstruction device 100.

FIG. 2 illustrates a rear view of the chamber obstruction device 100, according to examples of the present disclosure. In an embodiment, the first key 118 may be actuatable in a first direction 200 (e.g., in the Y-direction) when the correction combination of the second keys 120 are depressed in a second direction 202 (e.g., in the X-direction). The second direction 202 may be perpendicular or transverse to the first direction 200. As will be explained herein, each of the second keys 120 may be depressed by different amounts in the second direction 202 to permit the first key 118 to actuate (or be depressed) in the first direction 200. Biasing elements disposed within the housing 114 may bias the second keys 120 to a resting position, as shown in FIG. 2, whereby the second keys 120 extend out of the housing 114 by their greatest amount.

As will be explained herein, the second keys 120 may be at least partially secured within the housing 114 via fasteners. For example, the fasteners may prevent the second keys 120 being pulled out of the housing 114. In an embodiment, the chamber obstruction device 100 includes a cover 204 that exposes the fasteners to permit the user to interchange the second keys 120. For example, depending upon preferences of the user, the second keys 120 may be interchanged to adjust a combination to unlock the locking mechanism. The cover 204 may be moveable when a correction combination of the second keys 120 is depressed in the second direction and the first key 118 is actuated in the first direction 200. In other words, when the locking mechanism transitions to the unlocked state, the cover 204 is permitted to move to expose the fasteners of the second keys 120.

The first key 118 and the second keys 120 may protrude beyond a perimeter 206 or exterior of the housing 114. The first key 118 may protrude beyond the perimeter 206, along the top 110, whereas the second keys 120 may protrude from beyond the perimeter 206, along the second side 108.

In an embodiment, the cover 204 may be moveable between a first position in which access to the fasteners is restricted (e.g., obstructed, covered, etc.) and a second position in which access to the fasteners is permitted (e.g., unobstructed, uncovered, etc.). As shown in FIG. 2, the cover 204 is in the first position. In an embodiment, the fasteners may be accessible through apertures 208 disposed in the lid 116. A top surface, for example, of the cover 204 is shown being visible through the apertures 208. A first aperture 208(1) may provide access to a first fastener coupled to the second key 120(1), a second aperture 208(2) may provide access to a second fastener coupled to the second key 120(2), a third aperture 208(3) may provide access to a third fastener coupled to the second key 120(3), and a fourth aperture 208(4) may provide access to a fourth fastener coupled to the second key 120(4).

The cover 204, as explained herein, may correspondingly include apertures that align with the apertures 208 in the lid 116, thereby exposing the fasteners. In the first position of the cover 204, however, the apertures in the cover 204 may not be aligned with apertures 208 in the lid 116, thereby restricting access to the fasteners. However, in the second position of the cover 204, the apertures in the cover 204 may be aligned with the apertures 208 in the lid 116, thereby permitting access to the fasteners and allowing the user to interchange the second keys 120.

In an embodiment, the cover 204 may be permitted to translate (e.g., slide, move, etc.) between the first position to the second position when the locking mechanism is unlocked. In an embodiment, a slide 210 may be actuatable when the locking mechanism is unlocked to permit the cover 204 to move from the first position to the second position. For example, when the locking mechanism is in the unlocked state, the slide 210 may be actuated to permit the cover 204 to move from first position in which the fasteners are obstructed to the second position in which the fasteners are unobstructed.

In an embodiment, the slide 210 may include a handle 212 (e.g., knob, protrusion, knuckle, etc.) that is actuatable within a slot 214 of the lid 116. The handle 212 may move within the slot 214 during actuation of the slide 210. In an embodiment, the handle 212 may move within the slot 214, between a first position and a second position. In FIG. 2, the slide 210 is shown in the first position. In the first position of the slide 210, the cover 204 is restricted from moving from the first position to the second position of the slide 216. In the second position of the slide 210, however, the cover 204 is permitted to move from the first position to the second position. For example, when the locking mechanism transitions to the unlocked state, the slide 210 is permitted to move from the first position to the second position, which may correspondingly cause or permit the cover 204 to move from the first position to the second position.

The slide 210 may also control access to the tether 128. For example, the housing 114 may include a receptacle that receives an end of the tether 128. In the first position of the slide 210, the end of the tether 128 may be retained within the receptacle. In an embodiment, in the first position of the slide 210, the slide 210 may prevent the tether 128 from being removed from the receptacle. However, as the slide 210 moves to the second position, the slide 210 may no longer prevent the end of the tether 128 from being pulled out of the receptacle.

FIG. 3 illustrates a side view of the chamber obstruction device 100, according to examples of the present disclosure. As shown, the first key 118 may be disposed along the top 110, the second keys 120 may be disposed along the second side 108, the tether 128 may be disposed along the bottom 112, and the flange 122 may extend from the back 104. The latch 126 is further shown being disposed through the aperture 124 in the flange 122 to secure the chamber obstruction device 100 to the firearm.

When disposed within the chamber, the lid 116 may be disposed against a stock of the firearm, while the latch 126 may be disposed against an interior surface of the chamber. A distance may be disposed between the lid 116 and the chamber to accommodate a thickness of the firearm. Moreover, an end 300 of the flange 122 may abut the interior surface of the chamber. An indent 302 may accommodate a sidewall of the chamber.

The handle 212 of the slide 210 may extend from within the slot 214 for being actuatable by the user. As shown, the handle 212 may be located more proximate to the bottom 112 than the top 110.

Figure 4C:
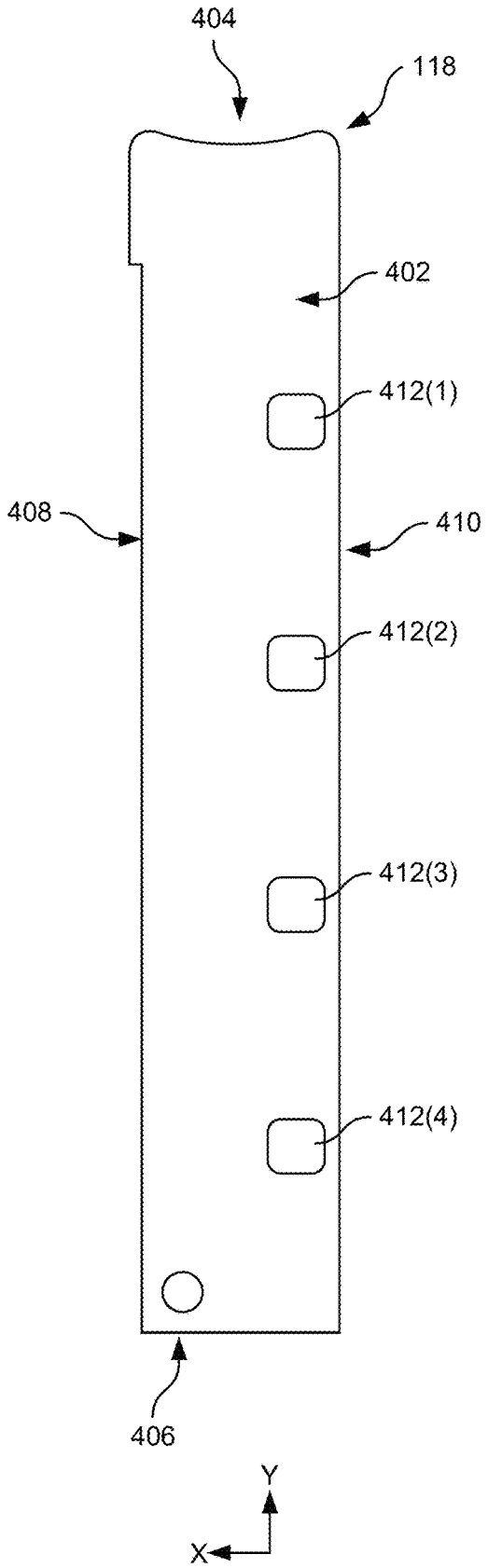
FIG. 4C illustrates a second side view of an example first key of a locking mechanism of the chamber obstruction device of FIGS. 1A and 1B, according to examples of the present disclosure.

FIGS. 4A-4C illustrate the first key 118, according to examples of the present disclosure. FIG. 4A illustrates an isometric view of the first key 118, FIG. 4B illustrates a first side 400 of the first key 118, and FIG. 4C illustrates a second side 402 of the first key 118, spaced apart from the first side 400 (e.g., in the Z-direction). The first key 118 includes a top 404 and a bottom 406 spaced apart from the top 404 (e.g., in the Y-direction). The first key 118 may also include a third side 408 and a fourth side 410 spaced apart from the third side 408 (e.g., in the X-direction). When installed on the chamber obstruction device 100, the second side 402 may be oriented towards the front 102, the first side 400 may be oriented towards the back 104, the third side 408 may be oriented towards the first side 106, and the fourth side 410 may be oriented towards the second side 108. The top 404 may be disposed external to the housing 114 and the bottom 406 may be disposed internal to the housing 114.

The second side 402 includes knobs 412, such as a first knob 412(1), a second knob 412(2), a third knob 412(3), and a fourth knob 412(4). In an embodiment, the knobs 412 may be disposed more proximate to the fourth side 410 than the third side 408. The knobs 412 are configured to align with receptacles in the second keys 120 to permit the first key 118 to be actuatable in the first direction 200. For example, when the first key 118 is actuatable in the first direction 200, the knobs 412 may be disposed in the receptacles of the second keys 120, respectively. The knobs 412 may be circular, square, hexagonal, etc., in shape.

The first side 400 includes a channel 414 that engages with the slide 210. In an embodiment, the channel 414 may include a first portion 416, a second portion 418, and a third portion 420. The first portion 416, the second portion 418, and the third portion 420 may be connected to one another. As will be explained herein, a pin of the slide 210 is configured to traverse within the different portions of the channel 414 to control a movement of the slide 210. For example, in the locked state of the locking mechanism, the pin may be disposed in the first portion 416. When disposed in the first portion 416, the slide 210 may be restricted from moving from the first position to the second position (e.g., in the second direction 202). For example, the pin may contact an edge of the channel 414 to restrict such movement. In such instances, the apertures 208 may obstruct the fasteners of the second keys 120 and the tether 128 may be secured to the housing 114.

During actuation of the first key 118 in the first direction 200, such as when the locking mechanism transitions to the unlocked state, the pin may be disposed out of the first portion 416. When disposed out of the first portion 416, the slide 210 may be actuated in the second direction 202. More particularly, the pin may be moved to the second portion 418 and out an end of the channel 414 (e.g., along the third side 408). When disposed out of the end, the slide 210 may no longer be engaged with the first key 118. However, to reengage the slide 210 and the first key 118, the first key 118 may be depressed in the first direction 200 (when the correct combination of second keys 120 is depressed) and the pin may be reinserted into the channel 414 (via the end).

The pin may be disposed in the third portion 420, which may be disposed more proximate to the top 404 than the first portion 416, when the first key 118 is actuated too far in the first direction 200. For example, when the pin is disposed in the first portion 416 and the first key 118 is depressed in the first direction 200, if pressed too far in the first direction 200, the pin may be disposed in the third portion 420. If the pin is disposed in the third portion 420, the slide 210 may be restricted from moving the second direction 202. For example, the pin may contact the edge of the channel 414 to restrict movement of the slide 210 in the second direction 202.

The first key 118 includes a neck 422 that extends from the first side 400. The neck 422 may engage with a latching mechanism that secures the chamber obstruction device 100 within the chamber of the firearm. For example, neck 422 may include a channel 424 that receives a portion of the latching mechanism to control movement of the latch into and out of the aperture 124. The channel 424 may be oriented in a direction outward from the first side 400, and may be angled upwards in a direction from the bottom 406 to the top 404.

Figure 5A:
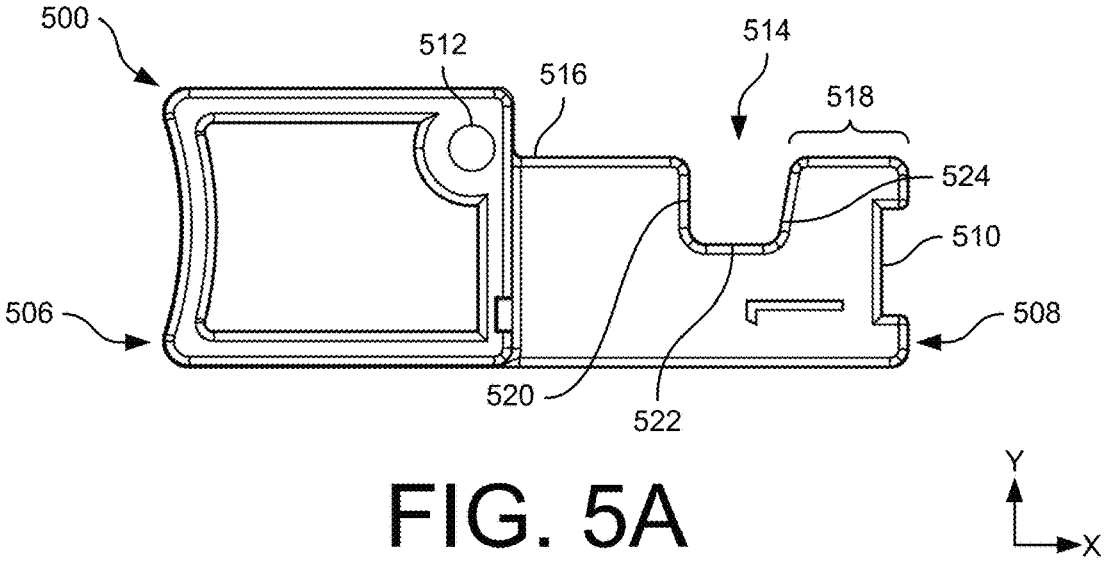
FIG. 5A illustrates a first type of an example second key of the locking mechanism, according to examples of the present disclosure.
Figure 5B:
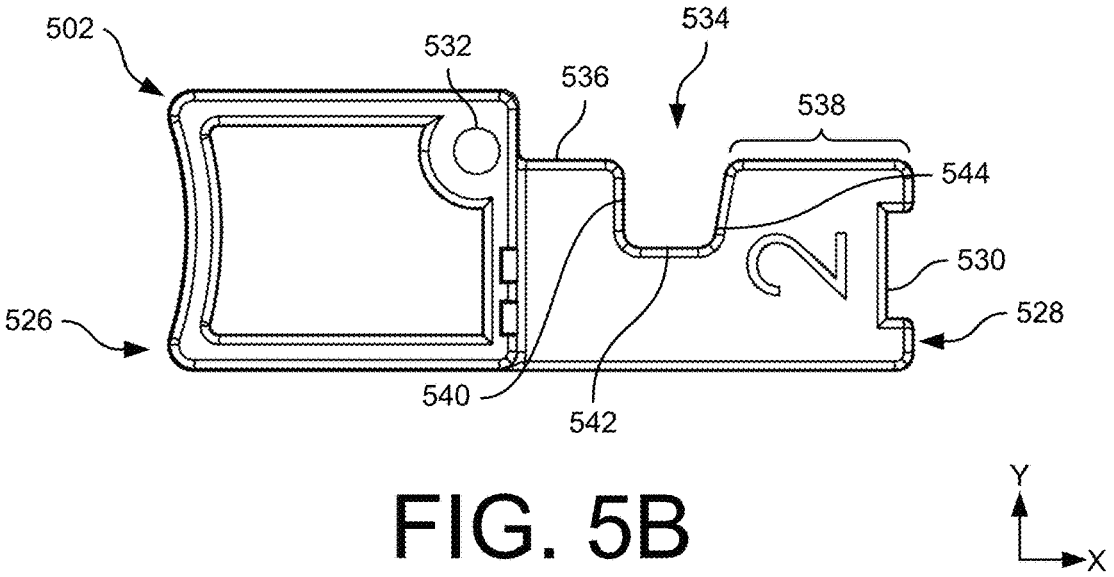
FIG. 5B illustrates a second type of an example second key of the locking mechanism, according to examples of the present disclosure.
Figure 5C:
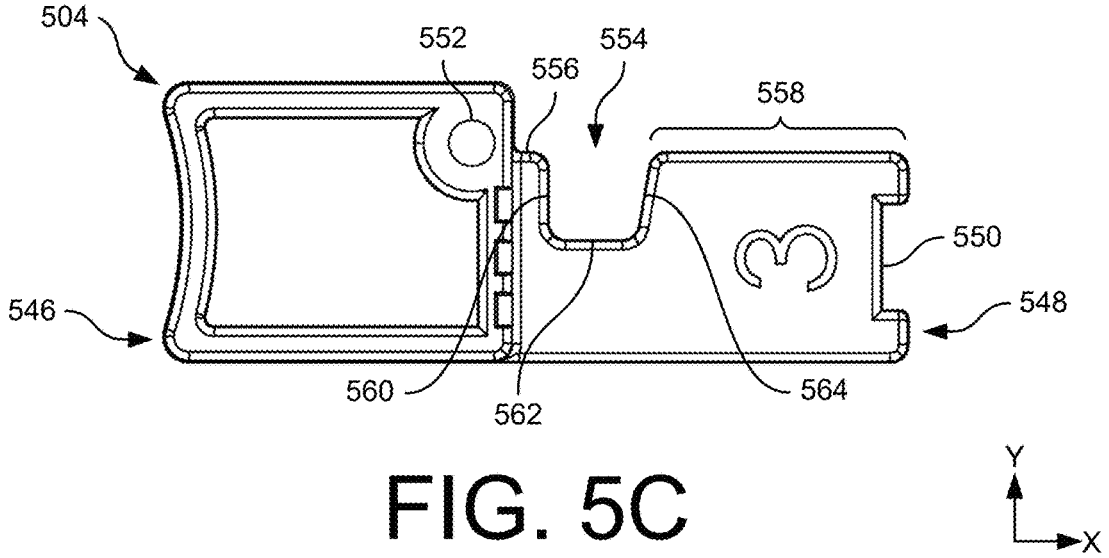
FIG. 5C illustrates a third type of an example second key of the locking mechanism, according to examples of the present disclosure.

FIGS. 5A-5C illustrate the one or more second keys 120, according to an embodiment of the present disclosure. FIG. 5A illustrates a first type 500 of the second keys 120, FIG. 5B illustrates a second type 502 of the second keys 120, and FIG. 5C illustrates a third type 504 of the second keys 120. In an embodiment, the first type 500 may correspond to the second key 120(1) and the second key 120(3), the second type 502 may correspond to the second key 120(2), and the third type may correspond to the second key 120(4).

The first type 500 of the second keys 120 includes a first end 506 and a second end 508 spaced apart from the first end 506 (e.g., in the X-direction). The first end 506 may be disposed external to the housing 114 and the second end 508 may be disposed within the housing 114. The first end 506 may be actuatable by the user, for example, and may include an indent for accommodating a shape, contour, etc., of a finger of the user. The second end 508 may include a notch 510 that seats, orients, positions, etc., a biasing element against the first type 500 of the second keys 120. A through hole 512 may receive a fastener that secures the first type 500 of the second keys 120 within the housing 114. When coupled to the housing 114, the fastener (or the through hole 512) may be disposed within the housing 114.

The first type 500 of the second keys 120 may also include a receptacle 514 that aligns with one of the knobs 412 of the first key 118. The receptacle 514 may be disposed in a side 516 of the first type 500 of the second keys 120 that extends between the first end 506 and the second end 508. The receptacle 514 may be sized to receive one of the knobs 412 such that the first key 118 is actuatable when the locking mechanism is unlocked. In an embodiment, the receptacle 514 may be spaced apart from the second end 508 by a first distance 518. In a resting state of the first type 500 of the second keys 120 (i.e., when not depressed), the receptacle 514 may be aligned with a respective knob on the first key 118 (e.g., the first knob 412(1) and the third knob 412(3), respectively). This means that the receptacle 514 of the first type 500 of the second key 120 are already aligned with corresponding knobs on the first key 118 and do not have to be depressed to allow the first key 118 to translate. However, if the first type 500 of the second key 120 is depressed (during an incorrect combination), the receptacle 514 is no longer aligned with knob the first key 118 is restricted from translating (e.g., via contacting the side 516).

The receptacle 514 may include a first sidewall 520, a second sidewall 522, and a third sidewall 524. The first sidewall 520 and the second sidewall 522 may be oriented orthogonal to one another. Comparatively, the third sidewall 524 may be disposed at an obtuse angle relative to the second sidewall 522 and/or non-parallel with the first sidewall 520. The orientation (e.g., slate, angle, tilt, etc.) of the third sidewall 524 may assist in urging one of the knobs 412 out of the receptacle 514. More particularly, when the biasing elements urge the first type 500 of the second keys 120, the third sidewall 524 may contact one of the knobs 412, and urge the knob 412 out of the receptacle 514. In doing so, the first key 118 may return to the resting position.

The second type 502 of the second keys 120 includes a first end 526 and a second end 528 spaced apart from the first end 526 (e.g., in the X-direction). The first end 526 may be disposed external to the housing 114, while the second end 528 may be disposed within the housing 114. The first end 526 may be actuatable by the user, for example, and may include an indent for accommodating a shape, contour, etc., of a finger of the user. The second end 528 may include a notch 530 that seats, orients, positions, etc., a biasing element against the second type 502 of the second keys 120. A through hole 532 may receive a fastener that secures the second type 502 of the second keys 120 within the housing 114. When coupled to the housing 114, the fastener (or the through hole 532) may be disposed within the housing 114.

The second type 502 of the second keys 120 may also include a receptacle 534 that aligns with one of the knobs 412 of the first key 118. The receptacle 534 may be disposed in a side 536 of the second type 502 of the second keys 120 that extends between the first end 526 and the second end 528. The receptacle 534 may be sized to receive one of the knobs 412 such that the first key 118 is actuatable when the locking mechanism is unlocked. In an embodiment, the receptacle 534 may be spaced apart from the second end 528 by a second distance 538. The second distance 538 may be greater than the first distance 518.

In a resting state of the second type 502 of the second keys 120 (i.e., when not depressed), the receptacle 534 may not be aligned with a respective knob on the first key 118 (e.g., the second knob 412(2)). However, the second type 502 of the second key 120 may be depressed by a distance such that the receptacle 534 aligns with the respective knob on the first key 118. However, if the second type 502 of the second key 120 is not depressed or is depressed too much, the receptacle 534 may not align with a corresponding knob on the first key 118 and the first key 118 is restricted from translating in the first direction 200 (e.g., via contacting the side 536). In an embodiment, the second type 502 of the second key 120 may be depressed halfway to align the receptacle 534 with the knob 412.

The receptacle 534 may include a first sidewall 540, a second sidewall 542, and a third sidewall 544. The first sidewall 540 and the second sidewall 542 may be oriented orthogonal to one another. Comparatively, the third sidewall 544 may be disposed at an obtuse angle relative to the second sidewall 542 and/or non-parallel with the first sidewall 540. The orientation (e.g., slate, angle, tilt, etc.) of the third sidewall 544 may assist in urging one of the knobs 412 out of the receptacle 534. More particularly, when the biasing elements urge the second type 502 of the second keys 120, the third sidewall 544 may contact one of the knobs 412 and urge the knob 412 out of the receptacle 534. In doing so, the first key 118 may return to the resting position.

The third type 504 of the second keys 120 includes a first end 546 and a second end 548 spaced apart from the first end 546 (e.g., in the X-direction). The first end 546 may be disposed external to the housing 114, while the second end 548 may be disposed within the housing 114. The first end 546 may be actuatable by the user, for example, and may include an indent for accommodating a shape, contour, etc., of a finger of the user. The second end 548 may include a notch 550 that seats, orients, positions, etc., a biasing element against the third type 504 of the second keys 120. A through hole 552 may receive a fastener that secures the third type 504 of the second keys 120 within the housing 114. When coupled to the housing 114, the fastener (or the through hole 552) may be disposed within the housing 114.

The third type 504 of the second keys 120 may also include a receptacle 554 that aligns with one of the knobs 412 of the first key 118. The receptacle 554 may be disposed in a side 556 of the third type 504 of the second keys 120 that extends between the first end 546 and the second end 548. The receptacle 554 may be sized to receive one of the knobs 412 such that the first key 118 is actuatable when the locking mechanism is unlocked. In an embodiment, the receptacle 554 may be spaced apart from the second end 548 by a third distance 558. The third distance 558 may be greater than the second distance 538.

In a resting state of the third type 504 of the second keys 120 (i.e., when not depressed), the receptacle 554 may not be aligned with a respective knob on the first key 118 (e.g., the fourth knob 412(4)). However, the third type 504 of the second key 120 may be depressed by a distance such that the receptacle 554 aligns with the respective knob on the first key 118. However, if the third type 504 of the second key 120 is not depressed or is depressed by an insufficient amount, the receptacle 554 may not align with a corresponding knob on the first key 118 and the first key 118 is restricted from translating in the first direction 200 (e.g., via contacting the side 556). In an embodiment, the third type 504 of the second key 120 may be depressed halfway to align the receptacle 554 with the knob 412.

The receptacle 554 may include a first sidewall 560, a second sidewall 562, and a third sidewall 564. The first sidewall 560 and the second sidewall 562 may be oriented orthogonal to one another. Comparatively, the third sidewall 564 may be disposed at an obtuse angle relative to the second sidewall 562 and/or non-parallel with the first sidewall 560. The orientation (e.g., slate, angle, tilt, etc.) of the third sidewall 564 may assist in urging one of the knobs 412 out of the receptacle 554. More particularly, when the biasing elements urge the third type 504 of the second keys 120, the third sidewall 564 may contact one of the knobs 412, and urge the knob 412 out of the receptacle 554. In doing so, the first key 118 may return to the resting position.

Given the different locations of the receptacle 514, the receptacle 534, and the receptacle 554, the second keys 120 may be depressed by different amounts in order to align with the knobs 412 of the first key 118. For example, the second keys 120 may be depressed halfway, fully, one-third, etc. Any combination of the second keys 120 may be used. The combination of the second keys 120 may be rearranged, or the second keys 120 may be interchangeable with one another to change the combination of the second keys 120 that are depressed to unlock the locking mechanism.

In an embodiment, the first type 500 of the second keys 120, the second type 502 of the second keys 120, and the third type 504 of the second keys 120 include indicia, markings, etc., that indicate their type. For example, the indicia may be used to distinguish the first type 500 of the second keys 120, the second type 502 of the second keys 120, and the third type 504 of the second keys 120 from one another. Although the second keys 120 are described as including three types, kinds, etc., more than or less than three types of the second keys 120 may be included. In such instances, the notches may be located differently than or, or at different locations on the second keys 120.

FIGS. 6A and 6B illustrate the housing 114 of the chamber obstruction device 100, according to examples of the present disclosure.

The housing 114 may include a front 600 and a back 602 spaced apart from the front 600 (e.g., in the Z-direction). The front 600 may correspond to the front 102 of the chamber obstruction device 100, and/or the back 602 may correspond to the back 104 of the chamber obstruction device 100. Additionally, the housing 114 may include a top 604 and a bottom 606 spaced apart from the top 604 (e.g., in the Y-direction). The housing 114 includes a first side 608 and a second side 610 spaced apart from the first side 608. The top 604 and the bottom 606 may correspond to the top 110 and the bottom 112 of the chamber obstruction device 100, respectively. The first side 608 and the second side 610 may correspond to the first side 106 and the second side 108 of the chamber obstruction device 100, respectively.

The housing 114 may define an opening 612 for accommodating the first key 118. For example, the top 404 of the first key 118 may be disposed through the opening 612 to be actuatable by the user. The second side 610 may define openings 614 for receiving the second keys 120. For example, the second keys 120 may be insertable into the openings 614. The openings 614 may include an opening 614(1) to accommodate the second key 120(1), an opening 614(2) to accommodate the second key 120(2), an opening 614(3) to accommodate the second key 120(3), and an opening 614(4) to accommodate the second key 120(4).

The back 602 may include a cavity 616 for receiving internal components of the chamber obstruction device 100. For example, the first key 118, the second keys 120, the slide 210, the cover 204, etc., may be at least partially disposed within the cavity 616. The lid 116 may be coupled to the housing 114 at the back 602 for enclosing the cavity 616.

The housing 114 may define slots 618 for receiving the second keys 120. The slots 618 may be representative of receptacles, channels, passages, etc. The second keys 120 may be translatable within the slots 618 during actuation of the second keys 120 (e.g., in the second direction 202). For example, the second key 120(1) may be translatable within a slot 618(1), the second key 120(2) may be translatable within a slot 618(2), the second key 120(3) may be translatable within a slot 618(3), and the second key 120(4) may be translatable within a slot 618(4). Each of the slots 618 may be in connection with one of the openings 614. When the second keys 120 are fully depressed, in the second direction 202, the second keys 120 may abut an end 620 of the slots 618, respectively. For example, the second end 508, the second end 528, and the second end 548 may abut the end 620 of the slots 618, respectively, as the second keys 120 are fully depressed in the second direction 202. An engagement between the second end 508, the second end 528, and the second end 548 may abut the end 620 of the slots 618 may prevent further actuation of the second keys 120 in the second direction 202.

The housing 114 may include grooves 622 that receive biasing elements that bias the second keys 120. For example, a first biasing element engaged with the second key 120(1) may reside, rest, etc., within a groove 622(1), a second biasing element engaged with the second key 120(2) may reside, rest, etc., within a groove 622(2), a third biasing element engaged with the second key 120(3) may reside, rest, etc., within a groove 622(3), and a fourth biasing element engaged with the second key 120(4) be reside, rest, etc., within a groove 622(4). The disposition of the biasing elements with the grooves 622, respectively, may seat, orient, etc., the biasing elements within the housing 114.

The housing 114 may also include grooves 624 that receive at least a portion of the fasteners that secure the second keys 120 within the housing 114. For example, ends of the fasteners (e.g., opposite the head) may translate between ends of the grooves 624 as the second keys 120 are actuated. The grooves 624 may include a first end 626 and a second end 628 spaced apart from the first end 626 (e.g., in the X-direction). In the resting state of the second keys 120, the fasteners that secure the second keys 120 within the housing 114 may be disposed adjacent to the first end 626 of the grooves 624. When the second keys 120 are fully depressed, the fasteners may be disposed adjacent to the second end 628. A groove 624(1) may accommodate a fastener that secures the second key 120(1) within the housing 114, a groove 624(2) may accommodate a fastener that secures the second key 120(2) within the housing 114, a groove 624(3) may accommodate a fastener that secures the second key 120(3) within the housing 114, and a groove 624(4) may accommodate a fastener that secures the second key 120(4) within the housing 114.

When the second keys 120 are in their resting state, as biased by the biasing elements, the fasteners may abut an interior surface 634. For example, a head of the fasteners may abut against the interior surface 634. An engagement between the fasteners with the interior surface 634 may retain the second keys 120 in the housing 114. However, when the fasteners are decoupled from the second keys 120, the fasteners may no longer retain the second keys 120 in the housing 114 and the second keys 120 may be pulled out the openings 614, respectively. In an embodiment, the head of the fasteners may engage with the interior surface 634 at a location above the openings 614, respectively, while an end of the fasteners (opposite the head) may engage with the first end 626 of the groove 624, respectively, below the openings 614.

The housing 114 defines a receptacle 630 for receiving the tether 128. For example, an end of the tether 128 may be insertable into the receptacle 630. The tether 128 may be secured within the receptacle 630 via the slide 210. For example, the slide 210 may be moved from the first position to the second position to permit the tether 128 to be removed from the within the receptacle 630. The tether 128 may be insertable into the receptacle 630 in the second position of the slide 210, and when the slide 210 is moved to the first position, the tether 128 may be secured within the receptacle 630. A portion of the receptacle 630 may be open along the bottom 606 to permit insertion of the tether 128 into the receptacle 630.

Dividers may separate the second keys 120 from one another to orient, position, etc., the second keys 120 within the housing 114. The dividers may maintain an orientation of the second keys 120 as the second keys 120 are actuated in the second direction 202 and return to their resting state. A first divider may be disposed between the second key 120(1) and the second key 120(2), a second divider may be disposed between the second key 120(2) and the second key 120(3), and a third divider may be disposed between the second key 120(3) and the second key 120(4). Other edges, surface, etc., of the housing 114 may assist in orienting the second keys 120.

The housing 114 may include a channel 632 that accommodates a portion of the handle 212. For example, a portion of the handle 212 may be disposed within the channel 632. An engagement between the portion of the handle 212 and the channel 632 may maintain an orientation of the slide 210 within the housing 114, for example, to permit the slide 210 to conveniently move in the second direction 202. The engagement between the handle 212 and the channel 632 may resist rotation of the slide 210 (e.g., about the Z-axis).

FIGS. 7A and 7B illustrate a resting state of the one or more second keys 120, according to examples of the present disclosure. FIG. 7A illustrates a cross-sectional view of the chamber obstruction device 100, taken along line C-C of FIG. 3. FIG. 7B illustrates a view of the chamber obstruction device 100 with the lid 116, the first key 118, the cover 204, and the slide 210 removed.

The chamber obstruction device 100 may include biasing elements 700 that act on the second keys 120. The biasing elements 700 act on the second keys 120 such that the second keys 120 all extend from the housing 114 by the same amount. For example, a first biasing element 700(1) may act on the second key 120(1), a second biasing element 700(2) may act on the second key 120(2), a third biasing element 700(3) may act on the second key 120(3), and a fourth biasing element 700(4) may act on the second key 120(4).

As the biasing elements 700 act on the second keys 120, the fasteners 702 may engage the interior surface 634 to retain the second keys 120 in the housing 114. However, the biasing elements 700 may be depressed via actuating the second keys 120 in the second direction 202. During this, the fasteners 702 may respectively move away from the interior surface 634 (e.g., in the second direction 202). A plate 704 may be disposed at least partially over the biasing elements 700 to retain the biasing elements 700 in position within the housing 114. Moreover, each of the biasing elements 700 may be disposed, or engage the second keys 120, within the notches of the second keys 120 (e.g., the notch 510, the notch 530, and/or the notch 550). The biasing elements 700 may also be disposed in the grooves 622 formed in the housing 114, respectively.

The fasteners 702 may abut the interior surface 634, adjacent to the openings 614, respectively in a resting state of the second keys 120, to retain the second keys 120 within the housing 114. The groove 624(1) may accommodate a fastener 702(1), the groove 624(2) may accommodate a fastener 702(2), the groove 624(3) may accommodate the fastener 702(3), and the groove 624(4) may accommodate a fastener 702(4).

As shown in FIG. 7A, in the resting state, the first knob 412(1) is aligned with the receptacle 514 of the second key 120(1), the second knob 412(2) is not aligned with the receptacle 534 of the second key 120(2), the third knob 412(3) is aligned with the receptacle 514 of the second key 120(3), and the fourth knob 412(4) is not aligned with the receptacle 554 of the second key 120(4). If the first key 118 were to be actuated in this scenario, the second knob 412(2) would contact the side 536 and the fourth knob 412(4) would contact the side 556. The first key 118 would be prevented from moving in the first direction 200.

Comparatively, if the second key 120(2) is depressed (e.g., halfway) in the second direction 202 and the second key 120(4) is depressed (e.g., fully) in the second direction, the receptacle 534 may align with the second knob 412(2) and the receptacle 554 may align with the fourth knob 412(4). Therein, with the knobs 412 aligning with the receptacles, respectively, the first key 118 may move in the first direction 200.

In an embodiment, the second keys 120 may include unlocking keys and locking keys. Unlocking keys are a version of the second keys 120 that inhibit movement of the first key 118 in the first direction 200 unless and until they are actuated. For example, until the unlocking keys are actuated in the second direction 202, by their respective amounts, the first key 118 is unable to move in the first direction 200 (provided that a correct combination of unlocking keys is actuated also). In an embodiment, the second type 502 of the second keys 120 and the third type 504 of the second keys 120 may be considered unlocking keys. In contrast, locking keys are a version of the one or more second keys 120 that do not inhibit movement of the first key 118 when they are in the resting position. However, when a locking key is actuated, the locking key prevents movement of the first key 118 in the first direction 200. The first type 500 of the second keys 120 may be considered locking keys.

Figure 8:
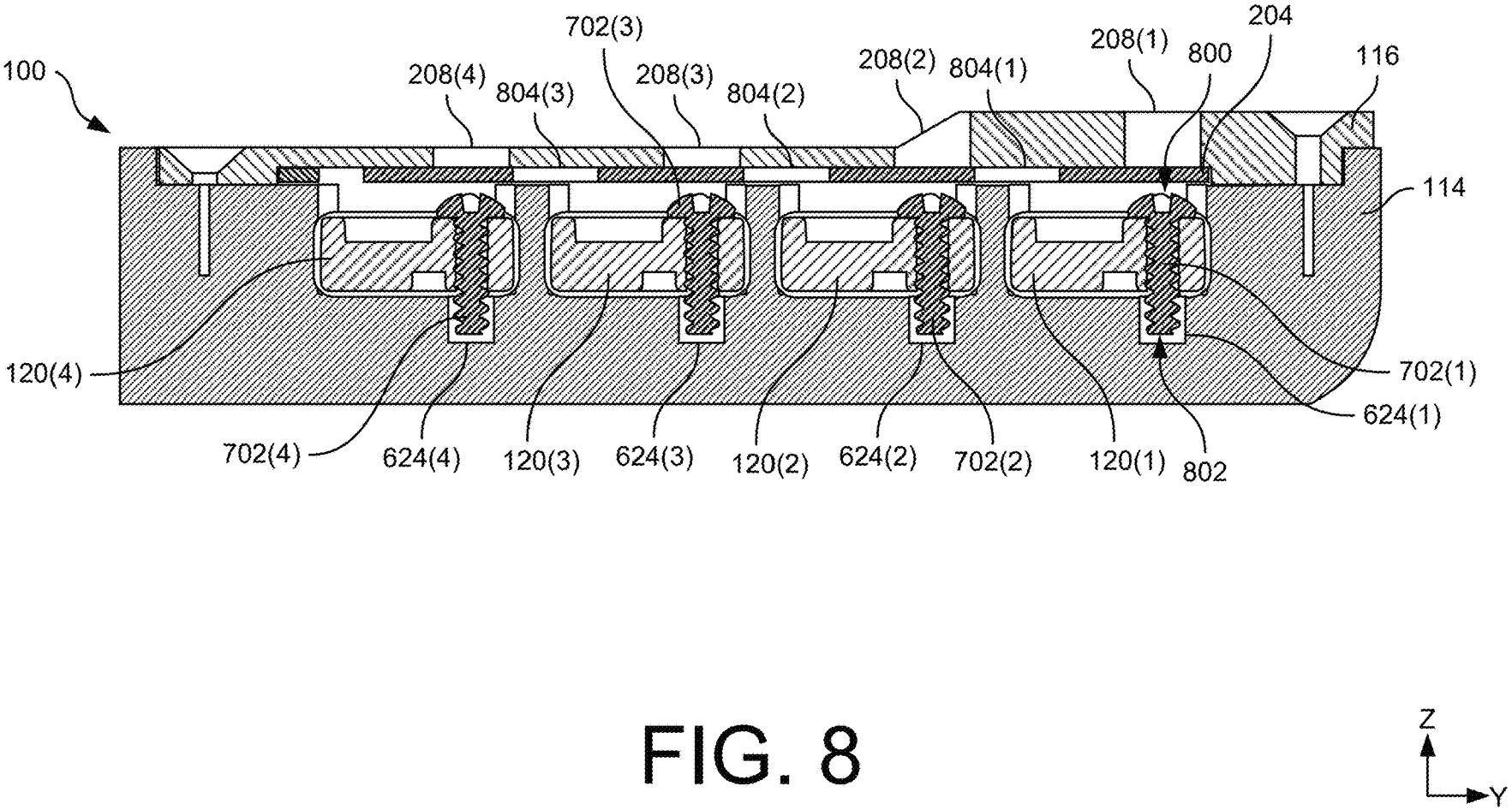
FIG. 8 illustrates a cross-sectional view of the chamber obstruction device of FIGS. 1A and 1B, taken along line A-A of FIG. 2, showing the second keys of FIGS. 5A-5C disposed within the housing of FIGS. 6A and 6B, according to examples of the present disclosure.

FIG. 8 illustrates a cross-sectional view of the chamber obstruction device 100, taken along line A-A of FIG. 2, according to examples of the present disclosure. As shown, the fasteners 702 may be coupled to and/or disposed through the second keys 120, respectively. For example, the first fastener 702(1) may be coupled to the second key 120(1), the second fastener 702(2) may be coupled to the second key 120(2), the third fastener 702(3) may be coupled to the second key 120(3), and the fourth fastener 702(4) may be coupled to the second key 120(4).

Each of the fasteners 702 may include a head 800 and an end 802. The head 800 may include socket (e.g., Phillips, standard, hex, etc.,) for coupling and uncoupling the fasteners 702 to the second keys 120, respectively. In the resting state of the second keys 120, the head 800 may abut the interior surface 634 of the housing 114, thereby retaining the second keys 120 in the housing 114. The end 802 of the fasteners 702 may translate within the grooves 624, respectively. In the resting state of the second keys 120, the end 802 of the fasteners 702 may abut the first end 626 of the grooves 624, respectively. An engagement between (i) the head 800 of the fasteners 702 with the interior surface 634 and (ii) the end 802 of the fasteners 702 and the first end 626 of the groove 624, may retain the second keys 120 in the housing 114. The fasteners 702 may be moveable within the grooves 624 until the end 802 abuts the second end 628 of the groove 624. An engagement with the end 802 and the second end 628 may restrict the second keys 120 moving further in the second direction 202.

The head 800 of the fasteners 702 may be visible when the fasteners 702 is disposed at the first end 626 of the grooves 624 and when the cover 204 is correspondingly moved to unobstruct the fasteners 702. For example, the lid 116 defines the apertures 208, while the cover 204 defines apertures 804. As shown in FIG. 8, the apertures 208 and the apertures 804 are not aligned (e.g., in the Y-direction), thereby concealing the fasteners 702. For example, the second aperture 208(2) of the lid 116 may not align with a first aperture 804(1) of the cover 204, the third aperture 208(3) of the lid 116 may not align with a second aperture 804(2) of the cover 204, and the fourth aperture 208(4) of the lid 116 may not align with a third aperture 804(3) of the cover 204. However, when the cover 204 is permitted to move, the apertures 804 may be brought into alignment with the apertures 208, thereby exposing the fasteners and permitting the second keys 120 to be interchanged. As such, the lid 116 may not have to be removed, or the chamber obstruction device 100 may not have to be disassembled, to interchange the second keys 120.

Moreover, when the fasteners 702 are uncoupled from the second keys 120, respectively, the fasteners 702 may no longer retain the second keys in the housing 114, thereby permitting the second keys 120 to be pulled out the openings 614, respectively. During replacement, a new second key 120 may be slid through the opening 614, and the fastener 702 may be installed into a corresponding through hole (e.g., once the through hole is disposed within the interior surface 634) in the second key 120.

FIGS. 9A and 9B illustrate a combination of the second keys 120 being depressed, according to examples of the present disclosure. The combination of the second keys 120 depressed in FIGS. 9A and 9B may correspond to a correct combination to unlock the locking mechanism, and permit the first key 118 to actuate in the first direction 200. For example, the second key 120(2) may be halfway depressed (e.g., in the X-direction) and the second key 120(4) may be fully depressed (e.g., in the X-direction), while the second key 120(1) and the second key 120(3) may not be depressed. As such, with the knobs 412 align with the receptacles, the first key 118 is permitted to actuate in the first direction 200.

As also shown, when the correct combination is pressed and the locking mechanism moves to the unlocked state, the latch 126 may recede within the aperture 124 in the flange 122. This permits the chamber obstruction device 100 to be removed from the firearm or coupled to the firearm. Moreover, as will be explained herein, in the unlocked state, the slide 210 is permitted to move from the first position to the second position, in the second direction 202, to correspondingly move the cover 204 and expose the fasteners 702 for interchanging the second keys 120. Movement of the slide 210 to the second position also permits the tether 128 to be removed from the receptacle 630 in the housing 114.

FIGS. 10A and 10B illustrate the correct combination of second keys 120 being depressed, according to examples of the present disclosure. FIG. 10A illustrates a cross-sectional view of the chamber obstruction device 100, taken along line F-F of FIG. 9B. FIG. 10B illustrates a view of the chamber obstruction device 100 with the lid 116, the first key 118, the cover 204, and the slide 210 removed.

Movement of the first key 118 in the first direction 200 is permitted when the knobs 412 align with corresponding receptacles in the second keys 120. For example, as shown in FIG. 10A, the first knob 412(1) is disposed within the receptacle 514, the second knob 412(2) is disposed within the receptacle 534, the third knob 412(3) is disposed within the receptacle 514, and the fourth knob 412(4) is disposed within the receptacle 554. The second key 120(1) may not be depressed to align the first knob 412(1) with the receptacle 514 and permit movement of the first key 118 in the first direction 200, the second key 120(2) may be depressed by a first amount to align the second knob 412(2) and permit movement of the first key 118 in the first direction 200, the second key 120(3) may not be depressed to align the third knob 412(3) with the receptacle 514 and permit movement of the first key 118 in the first direction 200, and the second key 120(4) may be depressed by a second amount to align the fourth knob 412(4) with the receptacle 554 and permit movement of the first key 118 in the first direction 200. The second amount may be greater than the first amount.

The locking mechanism may not remain the unlocked state after being unlocked. For example, the biasing elements 700 may respectively urge against the second keys 120, and urge the third sidewall 524, the third sidewall 544, and/or the third sidewall 564 against one of the knobs 412. This urging causes the knobs 412 to be displaced out of the receptacle 514, the receptacle 534, and the receptacle 554, respectively, thereby urging the first key 118 to the resting position. However, when in the unlocked state, and while the user continues to depress the first key 118 in the first direction 200, the slide 210 may be moved from the first position and the second position. Moreover, in the unlocked state, the user may release the second keys 120 that are depressed, while continuing to depress the first key 118. This depression of the first key 118 resists the biasing nature of the third sidewall 524, the third sidewall 544, and/or the third sidewall 564 against the knobs 412. For example, while continuing to depress the first key 118 in the unlocked state, the user may move the slide 210 to the second position to remove the tether 128 from the receptacle 630.

FIG. 11 illustrates the lid 116 of the chamber obstruction device 100 removed from the housing 114, according to examples of the present disclosure. In FIG. 11, the first key 118 and the second keys 120 are shown in their resting state (i.e., not depressed).

The cover 204 may include a first end 1100 and a second end 1102 spaced apart from the first end 1100 (e.g., in the Y-direction). When the lid 116 couples to the housing 114, the first end 1100 may abut an interior edge of the lid 116 to prevent movement of the cover 204 in a direction towards the top 110. The second end 1102 may abut an edge 1104 of the slide 210 to prevent movement of the cover 204 in a direction towards the bottom 112 (e.g., in first direction 200).

In FIG. 11, the cover 204 is shown in a first position in which the fasteners 702 are obstructed. For example, the cover 204 may be disposed over the fasteners 702 (e.g., in the Z-direction). However, when the slide 210, which is shown in a first position in FIG. 11, moves to a second position (e.g., in the second direction 202), the cover 204 is permitted to move to a second position (e.g., in the first direction 200) to expose the fasteners 702. Movement of the cover 204 may therefore be controlled, or permitted, via movement of the slide 210. More particularly, when the slide 210 moves in the second direction 202, the cover 204 may move in the first direction 200 to the second position. In the second position of the cover 204, apertures 804 of the cover 204 may align with the apertures 208 in the lid 116 to expose the fasteners 702. For example, the first aperture 804(1) may align with the second aperture 208(2) to expose the second fastener 702(2), the second aperture 804(2) may align with the third aperture 208(3) to expose the third fastener 702(3), and the third aperture 804(3) may align with the fourth aperture 208(4) to expose the fourth fastener 702(4). An aperture of the cover 204 may not align with the first aperture 208(1). Instead, when the first end 1100 moves in the first direction 200, the fastener 702(1) may be exposed via the aperture 208(1).

The slide 210 may include the handle 212 that permits movement of the slide 210 when the locking mechanism is in the unlocked state. In the unlocked state of the locking mechanism, a pin of the slide 210 may traverse the channel 414 of the first key 118.

FIG. 12 illustrates an engagement between the lid 116, the slide 210, and the cover 204, according to examples of the present disclosure. In FIG. 12, the cover 204 is shown in the first position and the slide 210 is shown in the first position. Here, the fasteners 702 may be obstructed and the tether 128 may be secured within the receptacle 630 of the housing 114.

The handle 212 of the slide 210 is disposed through the slot 214 in the lid 116. Although not shown, the slide 210 includes a pin disposed within the channel 414 of the first key 118. A rear surface 1200 of the lid 116 may define a cavity 1202 (e.g., groove, etc.) in which the slide 210 and/or the cover 204 are disposed. For example, the slide 210 and the cover 204 may be inset within the cavity 1202. An engagement between edges, surfaces, etc., of the slide 210 and the cover 204 with edges, surfaces, etc., of the rear surface 1200 of the lid 116, may orient the slide 210 and the cover 204 and/or permit the slide 210 and the cover 204 to move between the first position and the second position, respectively. For example, the slide 210 may engage with an edge 1204 of the cavity 1202 to align the slide 210 when moving between the first position and the second position.

FIG. 13 illustrates a cross-sectional view of the chamber obstruction device 100, taken along line D-D of FIG. 3, according to examples of the present disclosure. In FIG. 13, the locking mechanism is in the locked state. In the locked state, a pin 1300 of the slide 210 is disposed within the first portion 416 of the channel 414. When the pin 1300 is disposed in the first portion 416 of the channel 414, the slide 210 is prevented from moving in the second direction 202. That is, if in the locked state of the locking mechanism, the slide 210 is attempted to be moved in the second direction 202, the pin 1300 would abut an edge of the channel 414, thereby restricting movement. When the slide 210 is restricted from moving in the second direction 202, the cover 204 is restricted from moving in the first direction 200, and accordingly, the fasteners 702 may be obstructed.

The pin 1300, however, is configured to traverse within the channel 414 as the first key 118 is actuated. For example, when the correct combination of second keys 120 is depressed, the first key 118 is permitted to move in the first direction 200. When the first key 118 moves in the first direction 200, the pin 1300 may be disposed out of the first portion 416 of the channel 414, and permitted to move to the second portion 418 of the channel 414 during actuation of the slide 210 in the second direction 202. In an embodiment, when the slide 210 is permitted to move in the second direction 202, the pin 1300 may be disposed outside of the channel 414 (e.g., the pin 1300 may exit the second portion 418 of the channel 414). Accordingly, the slide 210 may be moved out of the channel 414 while the first key 118 is depressed in the first direction 200.

In an embodiment, if the first key 118 is actuated too far in the first direction 200, the pin 1300 may become disposed in the third portion 420 of the channel 414. If disposed in the third portion 420 of the channel 414, the slide 210 is prevented from moving in the second direction 202 as the pin 1300 may abut an edge of the channel 414, thereby restricting movement. If the pin 1300 is disposed in the third portion 420, actuation of the first key 118 in the first direction 200 may be slightly released to align the pin 1300 with the second portion 418 and permit movement of the slide 210 in the second direction.

FIG. 14 illustrates a cross-sectional view of the chamber obstruction device 100, taken along line G-G of FIG. 9B, according to examples of the present disclosure. In FIG. 14, the locking mechanism is in the unlocked state. For example, when the correct combination of second keys 120 has been depressed (e.g., in the second direction 202) the first key 118 is able to be depressed (e.g., in the first direction 200). As the first key 118 is actuated in the first direction 200, the pin 1300 may move out of the first portion 416 of the channel 414. When the pin 1300 is disposed out of the first portion 416, and is made accessible to the second portion 418, the slide 210 is permitted to move in the second direction 202. Movement of the slide 210 in the second direction 202 correspondingly permits movement of the cover 204 in the first direction 200 to unobstruct the fasteners 702.

The channel 414 may include the ramped section 1400 to maneuver the pin 1300 back into the channel 414 conveniently. For example, once the second keys 120 are interchanged and/or the tether 128 is released out of the receptacle 514, the slide 210 may move in a third direction 1402 opposite the second direction 202. In an embodiment, when the pin 1300 is disposed external to the channel 414, and when the slide 210 is actuated in the third direction 1402, the pin 1300 may be urged against the ramped section 1400. During this, the first key 118 may be urged in a fourth direction 1404 opposite the first direction 200. As the slide 210 moves in the third direction 1402, an edge of the slide 210 may engage with the cover 204. Engagement between the slide 210 and the cover 204, during movement of the slide 210 in the third direction 1402 urges the cover 204 to move in the fourth direction 1404, thereby obstructing the fasteners 702.

FIG. 15 illustrates the slide 210 in the second position and the cover 204 in the second position, according to examples of the present disclosure. As introduced above, when the slide 210 moves to the second position, the cover 204 is permitted to move to the second position. In the second position of the slide 210, the tether 128 may be released from the receptacle 630. In addition, the fasteners 702 may be exposed through the apertures 208 in the lid 116. When the fasteners 702 are exposed, the fasteners 702 may be removed from the second keys 120, and correspondingly, the second keys 120 may be permitted to be removed out the openings 614 in the housing 114 (e.g., via pulling in the third direction 1402). Therein, the second keys 120 may be replaced with other types of second keys 120 to adjust the combination to unlock the locking mechanism. The second keys 120 may be pushed into the openings 614 (e.g., in the second direction 202) until the through holes of the second keys 120 (e.g., the through hole 512, the through hole 532, and the through hole 552) aligns with the apertures 208, respectively. The fasteners 702 may then be reinserted into the second keys 120 to secure the second keys 120 within the housing 114.

As shown, the fasteners 702 may be visible through the apertures 208 in the resting state of the second keys 120, that is, when the second keys 120 are not depressed. However, In an embodiment, the second keys 120 may be depressed slightly in the second direction 202 to align the fasteners 702 with the apertures 208, respectively.

FIG. 16 illustrates the slide 210 in the second position and the cover 204 in the second position, according to examples of the present disclosure. In FIG. 16, the lid 116 is shown removed.

In the second position of the cover 204, the aperture 804(1) aligns with the aperture 208(2), the aperture 804(2) aligns with the aperture 208(3), and the aperture 804(3) aligns with the aperture 208(4). This makes the fastener 702(2), the fastener 702(3), and the fastener 702(4) visible through the lid 116 to permit their removal. The fastener 702(1) is made visible via the first end 1100 of the cover 204 unobstructing the aperture 208(1). In the second position of the slide 210, the pin 1300 may be disposed external to the channel 414. For example, the pin 1300 may exit out the second portion 418 of the channel 414.

In FIG. 16, after the locking mechanism is unlocked, the second keys 120 may return to their resting state. For example, the biasing elements 700 may urge against the second keys 120 to move the second keys 120 in the third direction 1402. At the same time, the third sidewall 524, the third sidewall 544, and/or the third sidewall 564 urges against one of the knobs 412 to urge the first key 118 in the fourth direction 1404. In an embodiment, the pin 1300 of the slide 210 may be moved out of the channel 414 to permit the first key 118 to move in the fourth direction 1404 and back to its resting state.

FIG. 17 illustrates the lid 116, according to examples of the present disclosure. The lid 116 has the rear surface 1200 that defines the cavity 1202 in which the slide 210 and the cover 204 are disposed. The lid 116 defines the apertures 208 as well as the slot 214 in which the handle 212 is configured to traverse. The slot 214 may include a first end 1700 and a second end 1702 spaced apart from the first end 1700 (e.g., in the X-direction). In the first position of the slide 210, the handle 212 may be disposed proximate to the first end 1700. In the second position of the slide 210, the handle 212 may be disposed proximate to the second end 1702.

The lid 116 may include openings 1704 for receiving fasteners to couple the lid 116 to the housing 114. The lid 116 also defines a passage 1706 through which the neck 422 of the first key 118 may be disposed for engaging with the latching mechanism. A cutout 1708 may accommodate removal of the tether 128 from within the receptacle 514. The rear surface 1200 may define a protrusion 1710 that is engageable by a portion of the slide 210 to prevent further movement of the slide 210 in the third direction 1402. The protrusion 1710 may also serve to align the slide 210 with the cover 204, for example, to advance the cover 204 in the fourth direction 1403.

The lid 116 may also include a slot 1712 that receives a portion of the pin 1300. In an embodiment, an engagement between the pin 1300 and the slot 1712 may maintain an orientation of the slide 210 as the slide 210 moves between the first position and the second position.

FIGS. 18A and 18B illustrate the slide 210, according to examples of the present disclosure. FIG. 18A illustrates an isometric view of a first side 1800 of the slide 210 and FIG. 18B illustrates an isometric view of a second side 1802 of the slide 210, opposite the first side 1800 (e.g., in the Z-direction). The first side 1800 may be oriented towards the front 102 of the chamber obstruction device 100 and the second side 1802 may be oriented towards the back 104 of the chamber obstruction device 100. The slide 210 further includes a top 1804 and a bottom 1806 opposite the top 1804 (e.g., in the Y-direction). The slide 210 may also include a third side 1808 and a fourth side 1810 opposite the third side 1808 (e.g., in the X-direction).

The pin 1300 may be located more proximate to the top 1804 as compared to the bottom 1806. The pin 1300 may include a first portion 1812 and a second portion 1814. The first portion 1812 may be disposed on the first side 1800 and the second portion 1814 may be disposed on the second side 1802. Stated alternatively, the pin 1300 may be disposed through a hole in the slide 210, whereby the first portion 1812 is disposed on the first side 1800 and the second portion 1814 is disposed on the second side 1802. The first portion 1812 is configured to be disposed in the channel 414 of the first key 118, while the second portion 1814 is configured to be disposed in the slot 1712.

The handle 212 may be located more proximate to the bottom 1806 as compared to the top 1804, and/or the fourth side 1810 as compared to the third side 1808. The handle 212 may include a first portion 1816 and a second portion 1818. The first portion 1816 may be disposed on the second side 1802 and the second portion 1818 may be disposed on the first side 1800. Stated alternatively, the handle 212 may be disposed through a hole in the slide 210, whereby the first portion 1816 is disposed on the second side 1802 and the second portion 1818 is disposed on the first side 1800. The first portion 1816 is configured to be disposed in the slot 214 of the lid 116. The second portion 1818 is configured to be disposed in the channel 632.

The slide 210 includes the edge 1104 that engages with the second end 1102 of the cover 204. As shown, the edge 1104 may be slanted, angled, oriented, etc., from the third side 1808 to the fourth side 1810, in a direction towards the top 1804. The slanted nature of the edge 1104 permits the slide 210 to act or urge the cover 204 from the second position to the first position.

A notch 1820 of the slide 210 accommodates the protrusion 1710. For example, an edge 1822 may abut a side of the protrusion 1710 to prevent further movement of the slide 210 in the third direction 1402 when the slide 210 is in the first position. Moreover, an edge 1824 may engage with a top of the protrusion 1710 to align the slide 210 with the cover 204. The edge 1822 and the edge 1824 may be oriented perpendicularly. In an embodiment, the edge 1104 is oriented at an acute angle, or extends at an acute angle, from the edge 1824.

FIG. 19 illustrates a cross-sectional view of latching mechanism 1900 of the chamber obstruction device 100, taken along line B-B of FIG. 2, according to examples of the present disclosure. The view shown in FIG. 19 illustrates the latching mechanism 1900 in a locked state. In the locked state, the latch 126 may be disposed external to the aperture 124 in the flange 122.

The flange 122 extends in a downward direction, away from the back 104. For example, the flange 122 may be disposed at an angle 1912 relative to the back 104 of the chamber obstruction device 100. In an embodiment, the angle 1912 may be between fifty degrees and sixty degrees. In an embodiment, the angle 1912 may be an acute angle.

The flange 122 defines a passage 1902 in which a key 1904 is disposed. The key 1904 may urge against the latch 126 to dispose the latch 126 external to the aperture 124. For example, the key 1904 may include a rib 1906 that engages with the latch 126. The rib 1906 may urge against an underneath side of the latch 126 to urge against the latch 126 and dispose the latch 126 at least partially through the aperture 124.

The key 1904 may be operably engaged within the channel 424 of the first key 118. For example, the key 1904 may include a strut 1908 (e.g., bar, post, etc.) disposed within the channel 424. When the locking mechanism moves to the unlocked state, in the first direction 200, the key 1904 may be urged in a direction towards an end 1910 of the channel 424. Movement of the strut 1908 within the channel 424 correspondingly moves the key 1904 in a direction that causes the rib 1906 to no longer bias the latch 126 out the aperture 124. For example, the key 1904 may move in a direction (e.g., parallel to the flange 122), thereby causing the rib 1906 to disengage with the latch 126. In doing so, the latch 126 may retract within the aperture 124.

FIG. 20 illustrates a cross-sectional view of the latching mechanism 1900 of the chamber obstruction device 100, taken along line E-E of FIG. 9A, according to examples of the present disclosure. The view shown in FIG. 20 illustrates the latching mechanism 1900 in an unlocked state. In the unlocked state, the latch 126 may be disposed internal to the aperture 124 in the flange 122. When the latch 126 is disposed internal to the aperture 124, the flange 122 may be insertable into the chamber of the firearm. As also shown, in the unlocked state of the latching mechanism 1900, the strut 1908 of the key 1904 may be disposed adjacent to the end 1910 of the channel 424. For example, when the first key 118 moves in the first direction 200, and engagement between the channel 424 and the strut 1908 may urge the strut 1908 in a direction towards the end 1910 of the channel 414.

After the flange 122 is inserted into the chamber, the first key 118 may be released, thereby causing the first key 118 to move in the fourth direction 1404. When the first key 118 moves in the fourth direction 1404, the channel 424 engages with the strut 1908 and pulls the key 1904. As the key 1904 moves, the rib 1906 is urged against the latch 126 and the latch 126 is returned to being disposed through the aperture 124.

While the foregoing invention is described with respect to the specific examples, it is to be understood that the scope of the invention is not limited to these specific examples. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Although the application describes embodiments having specific structural features and/or methodological acts, it is to be understood that the claims are not necessarily limited to the specific features or acts described. Rather, the specific features and acts are merely illustrative some embodiments that fall within the scope of the claims of the application.

What is claimed is:

1. A chamber obstruction device comprising:

a housing;

a lid coupled to the housing;

a latching mechanism that transitions between a locked state in which the chamber obstruction device is secured to a firearm and an unlocked state in which the chamber obstruction device is removable from the firearm;

a locking mechanism that transitions the latching mechanism between the locked state and the unlocked state, the locking mechanism including:

a first key that is actuatable in a first direction, the first key including one or more knobs, and second keys that are actuatable in a second direction that is transverse to the first direction, wherein individual keys of the second keys include a receptacle, wherein at least one of the second keys is actuatable in the second direction to align the receptacle of the at least one of the second keys with a knob of the one or more knobs such that the first key is actuatable in the first direction;

fasteners, wherein individual fasteners of the fasteners secure the individual keys of the second keys to the chamber obstruction device;

a cover that transitions between a first position in which the fasteners are obstructed and a second position in which the fasteners are unobstructed; and a slide engaged with the cover, the slide being moveable to permit the cover to transition between the first position and the second position.

2. The chamber obstruction device of claim 1, wherein the second keys include:

at least one unlocking key that, when actuated, permits the first key to be actuatable in the first direction; and at least one locking key that, when actuated, restricts the first key being actuatable in the first direction.

3. The chamber obstruction device of claim 2, wherein:

the individual keys of the second keys include a first end and a second end spaced apart from the first end;

the first end of the individual keys of the second keys are disposed external to the housing;

the second end of the individual keys of the second keys are disposed internal to the housing;

the at least one unlocking key includes a first receptacle that is spaced apart from the second end by a first distance; and the at least one locking key includes a second receptacle that is spaced apart from the second end by a second distance that is different than the first distance.

4. The chamber obstruction device of claim 1, wherein:

the housing includes a second receptacle configured to receive a portion of a tether;

the slide is configured to transition between a first position and a second position;

in the first position of the slide, the portion of the tether is secured within the second receptacle; and in the second position of the slide, the portion of the tether is removable from the second receptacle.

5. The chamber obstruction device of claim 4, wherein:

in the first position of the slide, the cover is in the first position; and in the second position of the slide, the cover is transitionable to the second position.

6. The chamber obstruction device of claim 4, wherein:

when the first key is actuatable in the first direction, the slide is transitionable between the first position and the second position; and when the first key is restricted from actuating in the first direction, the slide is restricted from transitioning between the first position and the second position.

7. A device configured to be at least partially disposed in a chamber of a firearm, the device comprising:

a housing;

a lid coupled to the housing;

a latch configured to engage with a portion of the chamber;

a locking mechanism that transitions between a locked state in which the latch is disposed external to the lid to engage with the portion of the chamber, and an unlocked state is which the latch is disposed internal to the lid to disengage with the portion of the chamber, the locking mechanism including:

a first key configured to actuate in a first direction, the first key including knobs, and second keys configured to actuate in a second direction that is different than the first direction, individual keys of the second keys including a receptacle, wherein at least one of the second keys is configured to actuate in the second direction to align the receptacle of the at least one of the second keys with a knob of the knobs such that the first key is actuatable in the first direction to transition the locking mechanism from the locked state to the unlocked state; and a cover configured to transition between a first position and a second position, wherein in the second position, a fastener that secures the individual keys of the second keys within the housing are unobstructed to permit the second keys to be interchangeable.

8. The device of claim 7, wherein the cover is configured to transition from the first position to the second position in the unlocked state of the locking mechanism.

9. The device of claim 7, further comprising a slide engaged with the cover, the slide configured to transition from a first position to a second position, wherein transitioning of the slide to the second position permits transitioning of the cover to the second position.

10. The device of claim 9, wherein:

the housing includes a second receptacle configured to receive a portion of a tether;

in the first position of the slide, the portion of the tether is secured within the second receptacle; and in the second position of the slide, the portion of the tether is removable from the second receptacle.

11. The device of claim 7, wherein:

the lid includes first apertures;

the cover includes second apertures; and in the second position of the cover, at least one of the second apertures aligns with at least one of the first apertures to unobstruct at least one of the fasteners.

12. The device of claim 7, wherein:

the second keys include:

a first type of second key, and a second type of second key;

the individual keys of the second keys include a first end and a second end spaced apart from the first end;

the first end of the individual keys of the second keys are disposed external to the housing;

the second end of the individual keys of the second keys are disposed internal to the housing;

the first type of second key includes a first receptacle that is spaced apart from the second end by a first distance; and the second type of second key includes a second receptacle that is spaced apart from the second end by a second distance that is different than the first distance.

13. The device of claim 12, wherein:

the second keys include a third type of second key; and the third type of second key includes a third receptacle that is spaced apart from the second end by a third distance that is different than the second distance.

14. The device of claim 7, further comprising a slide engaged with the cover, the slide including a pin and a handle, wherein:

the slide is configured to move to permit the cover to transition from first position to the second position;

the lid includes a slot through which the handle is disposed;

the first key includes a channel;

in the locked state, the pin is disposed within the channel; and in the unlocked state, the pin is disposed external to the channel.

* * * * *